US012075891B2

(12) United States Patent
Kozuka et al.

(10) Patent No.: US 12,075,891 B2
(45) **Date of Patent: *Sep. 3, 2024**

(54) LAST AND SHOE UPPER FORMING TOOL

(71) Applicant: ASICS CORPORATION, Kobe (JP)

(72) Inventors: Yuya Kozuka, Kobe (JP); Kimie Tanaka, Kobe (JP); Shinsaku Wakasugi, Kobe (JP); Shin Watanabe, Kobe (JP); Genki Hatano, Kobe (JP); Kei Kanematsu, Kobe (JP)

(73) Assignee: ASICS CORPORATION, Kobe (JP)

( * ) Notice: Subject to any disclaimer, the term of this patent is extended or adjusted under 35 U.S.C. 154(b) by 0 days.

This patent is subject to a terminal disclaimer.

(21) Appl. No.: 18/048,678

(22) Filed: Oct. 21, 2022

(65) Prior Publication Data

US 2023/0128436 A1 Apr. 27, 2023

(30) Foreign Application Priority Data

Oct. 22, 2021 (JP) ..... 2021-173324

(51) Int. Cl.
*A43D 3/02* (2006.01)
*A43D 3/06* (2006.01)

(52) U.S. Cl.
CPC ..... *A43D 3/06* (2013.01); *A43D 3/022* (2013.01); *A43D 3/027* (2013.01)

(58) Field of Classification Search
CPC ..... A43D 3/022; A43D 3/027
See application file for complete search history.

(56) References Cited

U.S. PATENT DOCUMENTS 39,034 A 6/1863 Clark
838,874 A 12/1906 Legge
(Continued)

FOREIGN PATENT DOCUMENTS

CN 108158134 A * 6/2018 ..... A43D 3/025
CN 109732913 A 5/2019
(Continued)

OTHER PUBLICATIONS

The extended European search report issued by the European Patent Office on Feb. 23, 2023, which corresponds to European Patent Application No. 22202413.5-1015 and is related to U.S. Appl. No. 18/048,678.

(Continued)

*Primary Examiner* — Ted Kavanaugh
(74) *Attorney, Agent, or Firm* — Studebaker & Brackett PC

(57) ABSTRACT

According to a last, in a forming surface for forming a shoe upper, at least a portion of a specific region corresponding to an upper end portion of a to-be-formed portion of the shoe upper is defined by a plurality of plate-shaped parts included in a plurality of last forming parts. By arranging the plate-shaped parts to be spaced apart from each other in a circumferential direction of an upper end portion of the shoe upper, a portion of the specific region that is defined by the plate-shaped parts is defined by an end surface of each of the plate-shaped parts. A recessed portion as a mark used for alignment with the last during overlaying of the shoe upper is in the portion of the specific region that is defined by the plate-shaped parts.

8 Claims, 19 Drawing Sheets

(56) References Cited

U.S. PATENT DOCUMENTS

| | | | | |
|---|---|---|---|---|
| 1,552,107 | A * | 9/1925 | Barna, Jr. | A43D 3/08 12/107 R |
| 1,565,057 | A * | 12/1925 | Chappell | A43D 3/027 12/124 |
| 1,905,786 | A * | 4/1933 | Bancroft | A43D 3/08 12/107 R |
| 1,947,246 | A | 2/1934 | Brauer et al. | |
| 3,228,049 | A | 1/1966 | Sbicca | |
| 3,952,427 | A * | 4/1976 | von den Benken | A43D 3/022 36/43 |
| 4,000,845 | A | 1/1977 | Zeller | |
| 4,031,586 | A * | 6/1977 | von den Benken | A43D 3/022 12/145 |
| 6,896,175 | B2 | 5/2005 | Duke et al. | |
| 11,547,181 | B2 * | 1/2023 | Kozuka | A43D 3/027 |
| 11,589,654 | B2 * | 2/2023 | Sakaguchi | A43B 23/0205 |
| 2011/0277250 | A1 | 11/2011 | Langvin et al. | |
| 2016/0206049 | A1 | 7/2016 | Kallayil | |
| 2018/0014609 | A1 | 1/2018 | Bruce et al. | |
| 2020/0113291 | A1 | 4/2020 | Smith | |

FOREIGN PATENT DOCUMENTS

| | | | | |
|---|---|---|---|---|
| FR | 2865358 | A1 * | 7/2005 | A43D 3/1433 |
| JP | 2002-63554 | A | 2/2002 | |
| JP | 2004-171081 | A | 6/2004 | |
| JP | 2017-81623 | A | 5/2017 | |
| JP | 2019-64719 | A | 4/2019 | |
| WO | 2017/115806 | A1 | 7/2017 | |

OTHER PUBLICATIONS

The extended European search report issued by the European Patent Office on Sep. 24, 2021, which corresponds to European Patent Application No. 21168427.9-1005.

An Office Action mailed by the Japanese Patent Office on Jun. 25, 2024, which corresponds to Japanese Application No. 2021-041707 with English translation.

* cited by examiner

100A

LAST AND SHOE UPPER FORMING TOOL

This nonprovisional application is based on Japanese Patent Application No. 2021-173324 filed on Oct. 22, 2021 with the Japan Patent Office, the entire contents of which are hereby incorporated by reference.

BACKGROUND OF THE INVENTION

Field of the Invention

The present invention relates to a last for shoe upper forming, on which a shoe upper is overlaid to thereby allow forming of the shoe upper, and also relates to a shoe upper forming tool including the last.

Description of the Background Art

When shoes are manufactured, generally, a last (a shoe last) for forming a shoe upper (hereinafter also simply referred to as an "upper") into a prescribed shape is used. The last has a surface including a forming surface, on which fabric or the like to be formed as an upper is overlaid, so that the upper is formed.

U.S. Patent Application Publication No. 2018/0014609 discloses manufacturing of shoes in a portable housing. U.S. Patent Application Publication No. 2016/0206049 discloses a last preform that can be reformed by shape-memory polymer. Chinese Patent No. 109732913 discloses manufacturing of a last by 3D printing.

SUMMARY OF THE INVENTION

If a last having a forming surface conforming to the shape of a wearer's foot can be easily fabricated, shoes excellently fitted to feet can be widely provided. As one method therefor, it is conceivable to manufacture a last by assembling a plurality of last forming parts including plate-shaped parts.

However, in the case where a last is manufactured by the method as described above, a certain gap (i.e., a portion where a plate-shaped part or the like is not provided) is produced in the surface of the last. This causes a problem as to how a yet-to-be formed upper (hereinafter also referred to as an upper forming material) is aligned and disposed with respect to the last when an upper is formed.

Thus, the present invention has been made in view of the above-described problems, and aims to facilitate alignment of a shoe upper during forming of the shoe upper in a last configured by combining a plurality of last forming parts including a plate-shaped part and a shoe upper forming tool including the last.

A last according to the present invention is for forming a shoe upper and includes a plurality of last forming parts. In a forming surface for forming the shoe upper, at least a portion of a specific region corresponding to an upper end portion of a to-be-formed portion of the shoe upper is defined by a plurality of plate-shaped parts included in the last forming parts. By arranging the plate-shaped parts to be spaced apart from each other in a circumferential direction of an upper end portion of the shoe upper, a portion of the specific region that is defined by the plate-shaped parts is defined by an end surface of each of the plate-shaped parts. In the last according to the present invention, a recessed portion as a mark used for alignment with the last during overlaying of the shoe upper is in the portion of the specific region that is defined by the plate-shaped parts.

A shoe upper forming tool according to a first aspect of the present invention includes: the last according to the present invention; and a fixing member having a string shape and used for fixing a shoe upper to the last. In the shoe upper forming tool according to the first aspect of the present invention, the recessed portion is shaped and sized to accommodate at least a part of the fixing member so as to allow the shoe upper to be sandwiched and held between the recessed portion and the fixing member.

A shoe upper forming tool according to a second aspect of the present invention includes: the last according to the present invention; and a fixing member having a string shape and used for fixing a shoe upper to the last. In the shoe upper forming tool according to the second aspect of the present invention, the recessed portion is shaped and sized to retain the fixing member accommodated in the recessed portion.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
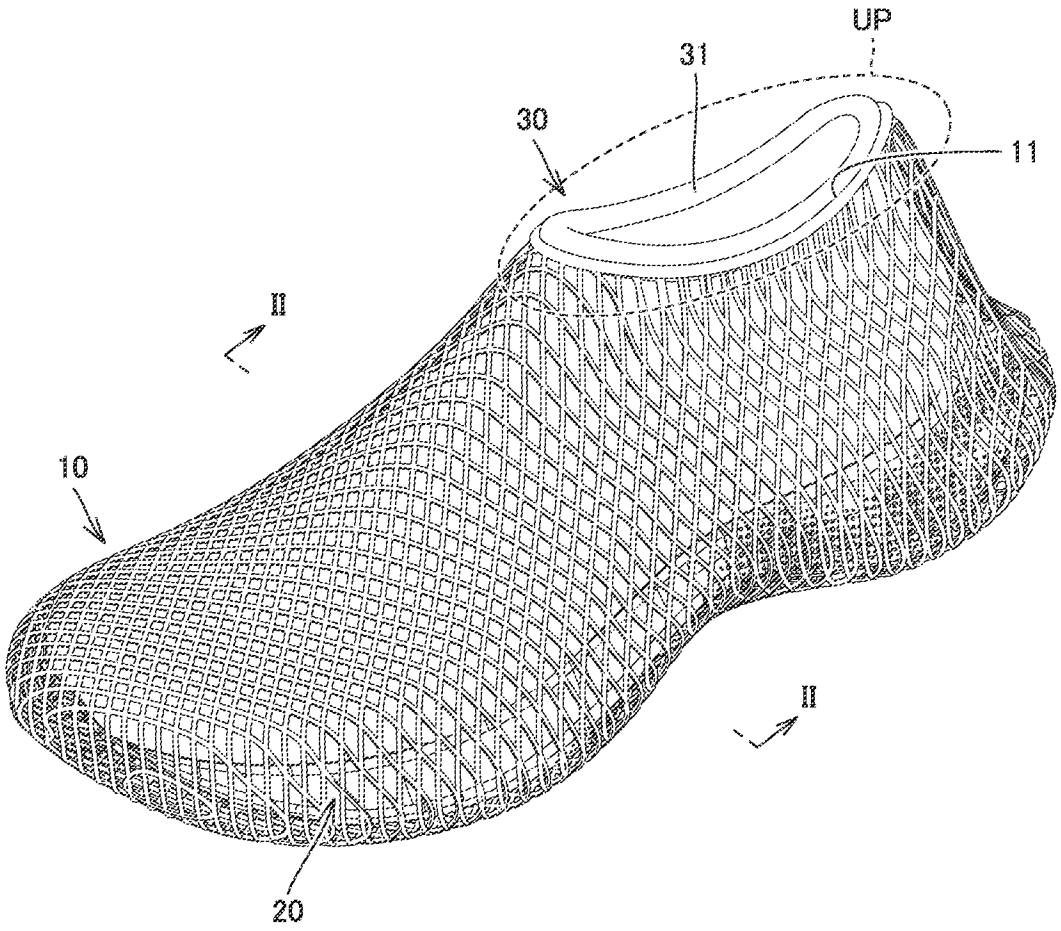
FIG. 1 is a perspective view showing an example of a shoe manufactured using a last according to a first embodiment.

In the following, embodiment of the present invention will be described in detail with reference to the accompanying drawings. In the embodiments described below, the same or corresponding portions are denoted by the same reference characters, and the description thereof will not be repeated. The following description includes terms such as a front-rear direction, a right-left direction, and an up-down direction. These terms referring to directions indicate the directions viewed from a wearer who wears shoes placed on a flat surface such as the ground. For example, the front side refers to a toe side while the rear side refers to a heel side.

First Embodiment

Figure 2:
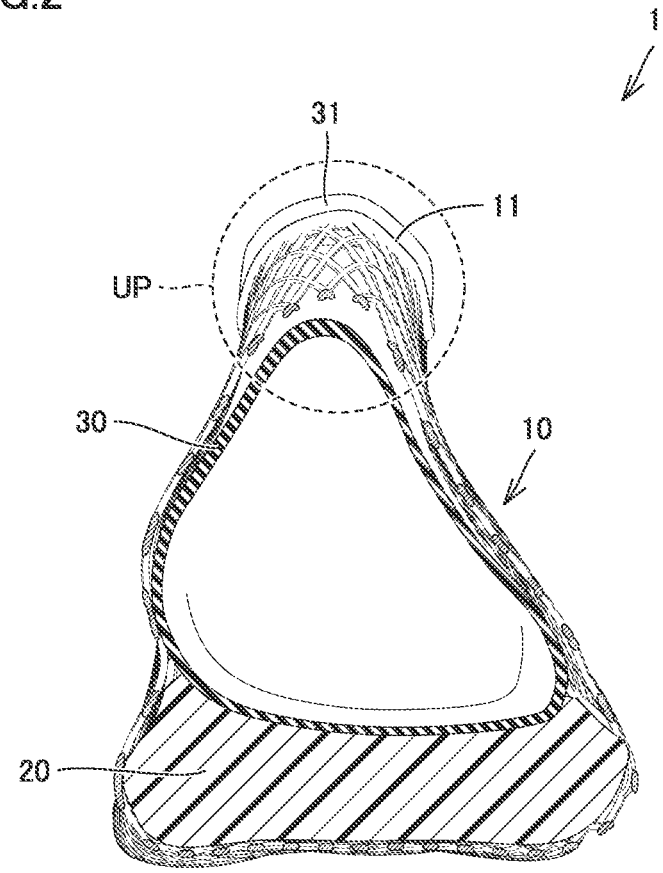
FIG. 2 is a cross-sectional view of the shoe shown in FIG. 1.
Figure 3:
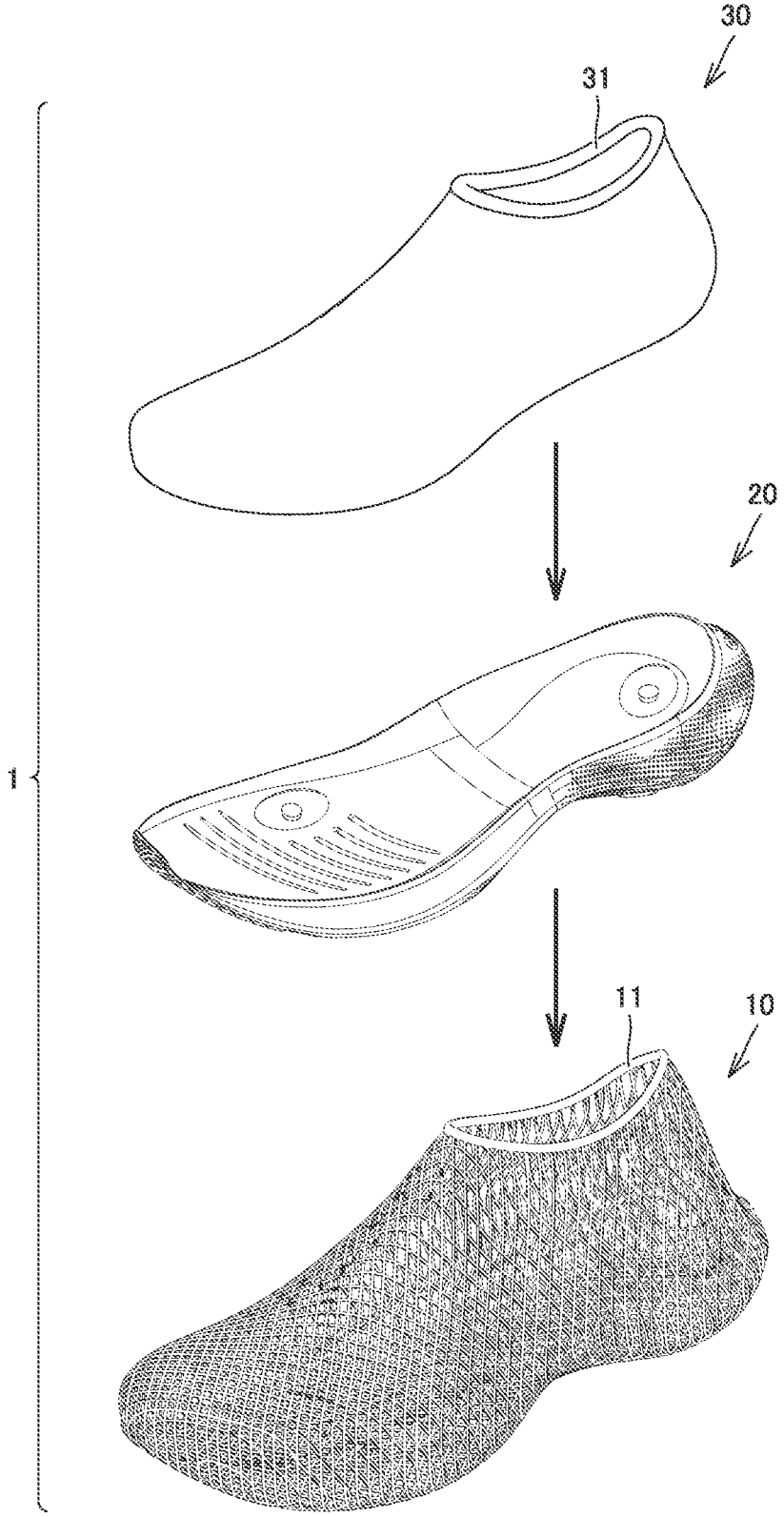
FIG. 3 is an exploded perspective view of the shoe shown in FIG. 1.

FIG. 1 is a perspective view showing an example of a shoe manufactured using a last according to the first embodiment. FIG. 2 is a cross-sectional view taken along a line II-II shown in FIG. 1. FIG. 3 is an exploded perspective view of the shoe shown in FIG. 1. Before explaining a last according to the present embodiment, a shoe 1 manufactured using the last will be first described with reference to FIGS. 1 to 3.

As shown in FIGS. 1 to 3, the shoe 1 is formed in a sock shape that substantially entirely covers a foot (i.e., a portion extending from an ankle to a distal end) of a wearer, and includes a shell 10, a sole 20, and an upper 30. Along an upper portion of the shoe 1, a topline 31 is provided through which a foot is inserted. Inside the shoe 1, a space is provided in which a wearer's foot is inserted when the wearer wears the shoe 1.

In the shoe 1, the sole 20 is accommodated in the shell 10, and the upper 30 is accommodated in the shell 10 to be located on the sole 20. Thereby, the sole 20 is sandwiched between the shell 10 and the upper 30.

The shell 10 constitutes an outermost shell of the shoe 1 and is formed of a single flexible member having a bag shape. The shell 10 has an upper end provided with an opening 11. The shell 10 covers a bottom surface and a circumferential surface of the sole 20 and a surface of the upper 30. The outer surface of the bottom of the shell 10 constitutes a ground contact surface of the shoe 1.

The shell 10 may be basically made of any material as long as it has flexibility, but preferably has appropriate strength. From this viewpoint, the shell 10 is preferably made of a resin material or a rubber material. Further, the shell 10 can be fabricated, for example, by injection molding, cast molding, or molding using a three-dimensional additive manufacturing apparatus. In particular, fabricating the shell 10 by molding using such a three-dimensional additive manufacturing apparatus makes it possible to fabricate shells 10 having a wide variety of structures that are difficult to be fabricated by injection molding or cast molding.

The sole 20 is a portion of the shoe 1 that supports a foot sole of a wearer, and is formed of an elastically-deformable flat member. The sole 20 is disposed in the space provided inside the shell 10 to be located in a lower space close to the ground contact surface.

The sole 20 may basically be made of any material as long as it is elastically deformable but is preferably formed of a member having suitable strength while maintaining excellent cushioning. From this viewpoint, the sole 20 is made using, for example, a resin-made foam material containing: a resin material as a main component; and a foaming agent and a cross-linking agent as sub-components. Alternatively, the sole 20 may be made using a rubber-made foam material containing: a rubber material as a main component; and a plasticizer, a foaming agent, a reinforcing agent, and a cross-linking agent as sub-components.

The upper 30 is a portion of the shoe 1 that comes into contact with the wearer's foot, and is formed of a flexibly deformable member having a bag shape. The upper 30 is disposed in the space provided inside the shell 10 to be located in an upper space close to the opening 11. Further, an upper end of the upper 30 is located so as to protrude outward from the opening 11, and a portion of the upper 30 that protrudes from the opening 11 forms the above-mentioned topline 31.

The upper 30 may basically be formed of any material as long as it is flexibly deformable, but is preferably made using woven fabric, knitted fabric, nonwoven fabric, synthetic leather, resin, or the like. In particular, as described later, by using woven fabric, knitted fabric, nonwoven fabric, or the like made of synthetic fibers having heat shrinkability, the upper that is more excellently fitted to the wearer's foot can be produced. Examples of synthetic fibers having heat shrinkability include those containing polyester, polyurethane, or the like as a main component.

In other words, in the case where the upper 30 is formed of woven fabric, knitted fabric, nonwoven fabric, or the like made of synthetic fibers having heat shrinkability, the upper 30 is formed in a bag shape in advance, into which a last (described later) is inserted and then subjected to a heat treatment. Due to heating, the upper 30 is thermally shrunk, so that the upper 30 is changed in shape and comes into close contact with the forming surface of the last, and then, this changed shape is maintained. Accordingly, a last conforming to the shape of the wearer's foot is prepared and used to form the upper 30 as described above, and thereby, the upper 30 fitted to the wearer's foot can be fabricated. Further, when the above-mentioned heat treatment is performed together with the last in the state in which the upper 30 is assembled in the shell 10, the upper 30 is fitted also to the shell 10, which allows a further improved fit.

Figure 4:
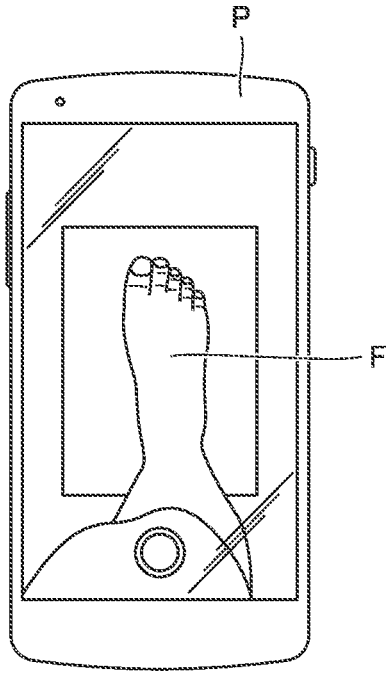
FIG. 4 is a diagram showing a state in which a wearer's foot is photographed in order to obtain a foot model.
Figure 5:
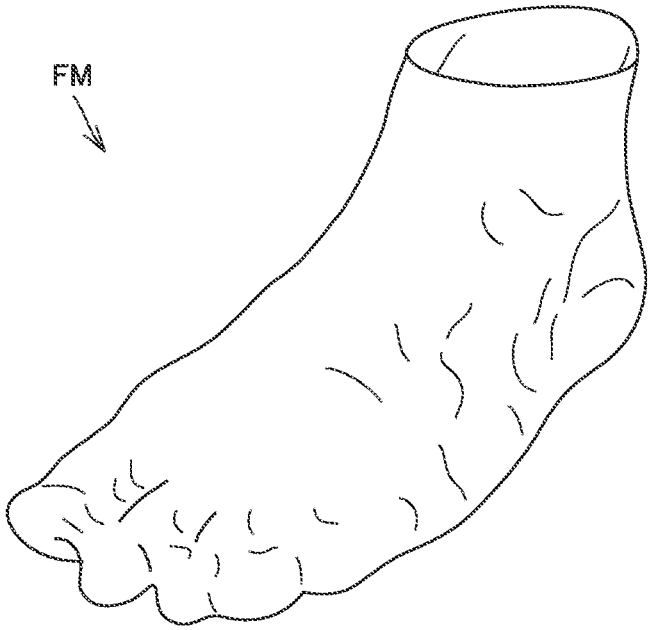
FIG. 5 is a perspective view of the foot model.
Figure 6:
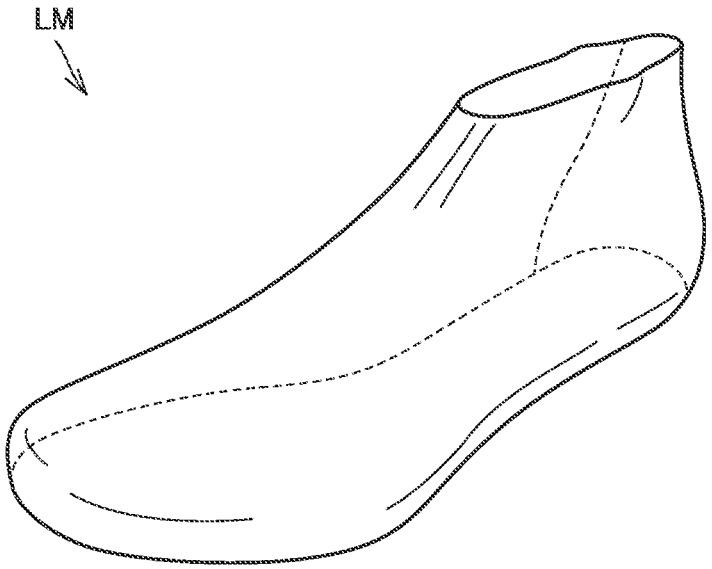
FIG. 6 is a perspective view of a last model produced based on the foot model.

FIG. 4 is a diagram showing the state in which a wearer's foot is photographed in order to obtain a foot model. FIG. 5 is a perspective view of the foot model. FIG. 6 is a perspective view of a last model produced based on the foot model. Referring to FIGS. 4 to 6, the following describes an example of a method of producing a last model in the case of manufacturing a last conforming to the shape of a wearer's foot.

As shown in FIG. 4, when the last model is produced, a foot F of a wearer is first photographed by a portable terminal such as a smartphone P or a digital camera capable of taking pictures, and then, image data of the foot F is obtained. The image data of the foot F may be obtained by taking pictures in a store visited by the wearer. The store may be a brick-and-mortar (physical) store or a mobile store such as an automobile and a trailer. Further, the image data of the foot F may be obtained by taking pictures in the wearer's house. In this case, for example, the image data of the foot F obtained by taking pictures by the wearer is transmitted to a server of a shoe manufacturer.

As shown in FIG. 5, a foot model FM is a three-dimensional model produced based on the measurement data of each part of the wearer's foot F, which is obtained from the image data of the foot F. For example, when the wearer's foot F is photographed by the smartphone P, the foot model FM can be produced based on the image data by software installed in advance in the smartphone P. Further, the foot model FM may also be produced by performing computations using both the data of the captured image and the data in a server used by the shoe manufacturer.

The foot model FM may be formed in the same shape as the shape of the wearer's foot F. Also, for design or functional reasons, a specific part of the foot model FM may be corrected by desired dimensions with respect to the shape of the wearer's foot F.

As shown in FIG. 6, a last model LM is a model produced based on the foot model FM shown in FIG. 5 and customized to conform to the shape of the wearer's foot F. By fabricating a last based on this last model LM, the last conforming to the shape of the wearer's foot can be manufactured.

Figure 7:
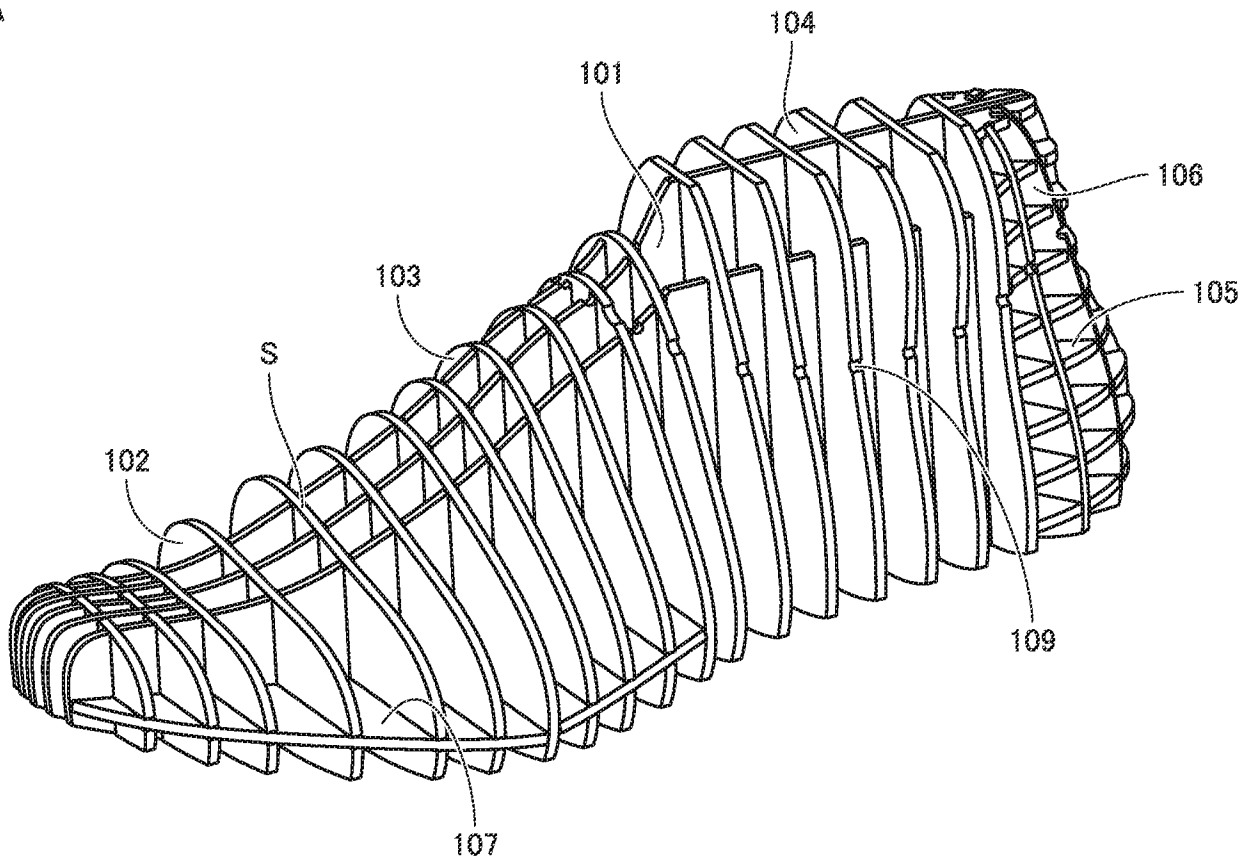
FIG. 7 is a perspective view of the last according to the first embodiment.

FIG. 7 is a perspective view of the last according to the present embodiment. Referring to FIG. 7, the configuration of a last 100A according to the present embodiment will be hereinafter described. Note that the last 100A according to the present embodiment is fabricated based on the above-described method of producing a last model and conforms to the shape of a wearer's foot.

As shown in FIG. 7, the last 100A is formed by combining a plurality of detachable plate-shaped parts. The plurality of plate-shaped parts include a plurality of foot length direction parts 101, a plurality of toe parts 102, a plurality of instep parts 103, a plurality of ankle parts 104, a plurality of circumferential heel parts 105, a plurality of vertical heel parts 106, and a plurality of laterally extending parts 107.

Each of the plurality of foot length direction parts 101 is formed of a plate-shaped part extending in the front-rear direction (i.e., the foot length direction) and the up-down direction (i.e., the direction orthogonal to both the foot length direction and the foot width direction). The plurality of foot length direction parts 101 include two types of parts including longer parts and shorter parts (see FIG. 8). The longer parts of the plurality of foot length direction parts 101 are used as a base frame of the last 100A, and disposed to extend in the front-rear direction at a substantially central portion in the right-left direction (i.e., the foot width direction). Each of the shorter parts of the plurality of foot length direction parts 101 is disposed at a position corresponding to the front end of the wearer's toe.

Each of the plurality of toe parts 102 is formed of a plate-shaped part extending in the right-left direction and the up-down direction. The plurality of toe parts 102 each are disposed at a position corresponding to the wearer's toe and are assembled into the plurality of foot length direction parts 101.

Each of the plurality of instep parts 103 is formed of a plate-shaped part extending in the right-left direction and the up-down direction. The plurality of instep parts 103 each are disposed at a position corresponding to the wearer's instep, and are assembled into the plurality of foot length direction parts 101.

Each of the plurality of ankle parts 104 is formed of a plate-shaped part extending in the right-left direction and the up-down direction. The plurality of ankle parts 104 each are disposed at a position corresponding to the wearer's ankle, and are assembled into the plurality of foot length direction parts 101.

Each of the plurality of circumferential heel parts 105 is formed of a plate-shaped part extending in the front-rear direction and the right-left direction. The plurality of circumferential heel parts 105 each are disposed at a position corresponding to the wearer's heel, and are assembled into the plurality of foot length direction parts 101.

Each of the plurality of vertical heel parts 106 is formed of a plate-shaped part extending in the up-down direction. The plurality of vertical heel parts 106 are arranged radially in a range of approximately 180° around an axis extending in the up-down direction. The plurality of vertical heel parts 106 each are disposed at a position corresponding to the wearer's heel, and are assembled into the plurality of circumferential heel parts 105.

Each of the plurality of laterally extending parts 107 is formed of a plate-shaped part extending in the front-rear direction and the right-left direction. The plurality of laterally extending parts 107 each are disposed at a position corresponding to the wearer's toe and instep, and are assembled into the plurality of toe parts 102 and the plurality of instep parts 103.

In the state in which the plurality of foot length direction parts 101, the plurality of toe parts 102, the plurality of instep parts 103, the plurality of ankle parts 104, the plurality of circumferential heel parts 105, the plurality of vertical heel parts 106, and the plurality of laterally extending parts 107 are combined with each other, the end surfaces of these parts (i.e., the surfaces extending in the thickness direction of these plate-shaped parts) define a forming surface S of the last 100A. Then, an upper forming material is overlaid to cover the forming surface S, and thereby, the upper 30 is formed.

Specifically, when the upper 30 is formed, the upper forming material is overlaid on the last 100A so as to cover the forming surface S as described above, which is then subjected to a heat treatment. As described above, particularly when the upper 30 is formed of woven fabric, knitted fabric, nonwoven fabric, or the like made of synthetic fibers having heat shrinkability, the heat shrinking yarns contained in the upper 30 shrink due to this heat treatment, with the result that the upper 30 is fabricated along the forming surface S of the last 100A.

In this case, a slit having a cutout shape, an engaging portion having a protruding shape, and a to-be-engaged portion having a through hole shape are provided at prescribed positions in each of the plurality of plate-shaped parts. The slit, the engaging portion, and the to-be-engaged portion serve as assembly sections when the plurality of plate-shaped parts are assembled together, which will be described later in detail.

Further, a recessed portion 109 is provided at a prescribed position of the last 100A. The recessed portion 109 is used as an indicator for positioning the upper forming material when the upper 30 is formed, which will be described later in detail.

The plurality of foot length direction parts 101, the plurality of toe parts 102, the plurality of instep parts 103, the plurality of ankle parts 104, the plurality of circumferential heel parts 105, the plurality of vertical heel parts 106, and the plurality of laterally extending parts 107 each are formed of a wooden board, and more specifically, are cut out from wooden boards B1 and B2 as materials (see FIGS. 8 and 9), which will be described later.

Figure 8:
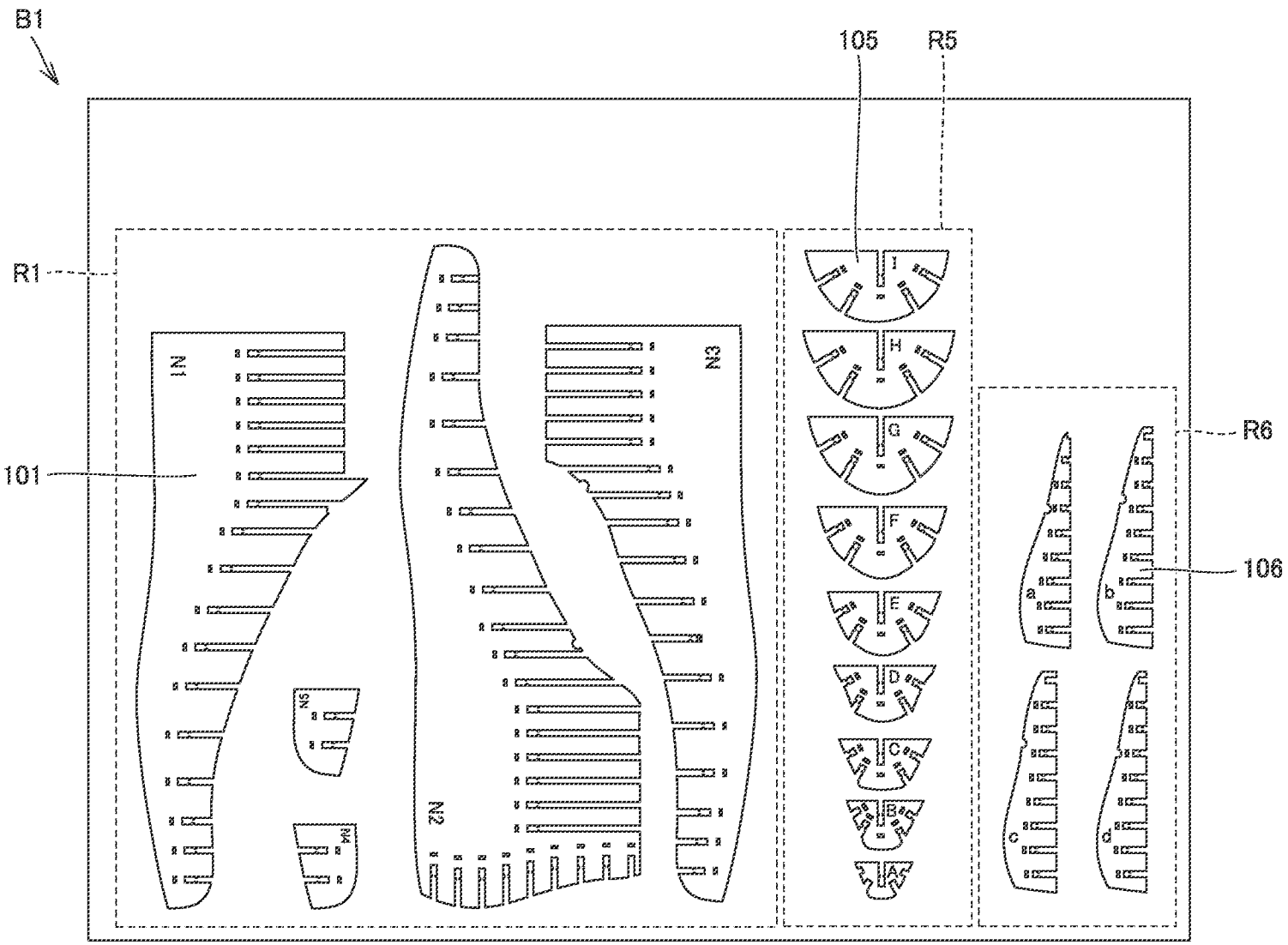
FIG. 8 is a plan view showing, in a visualized manner, a cutting pattern of a wooden board from which some of a plurality of plate-shaped parts included in the last shown in FIG. 7 are cut out.
Figure 9:
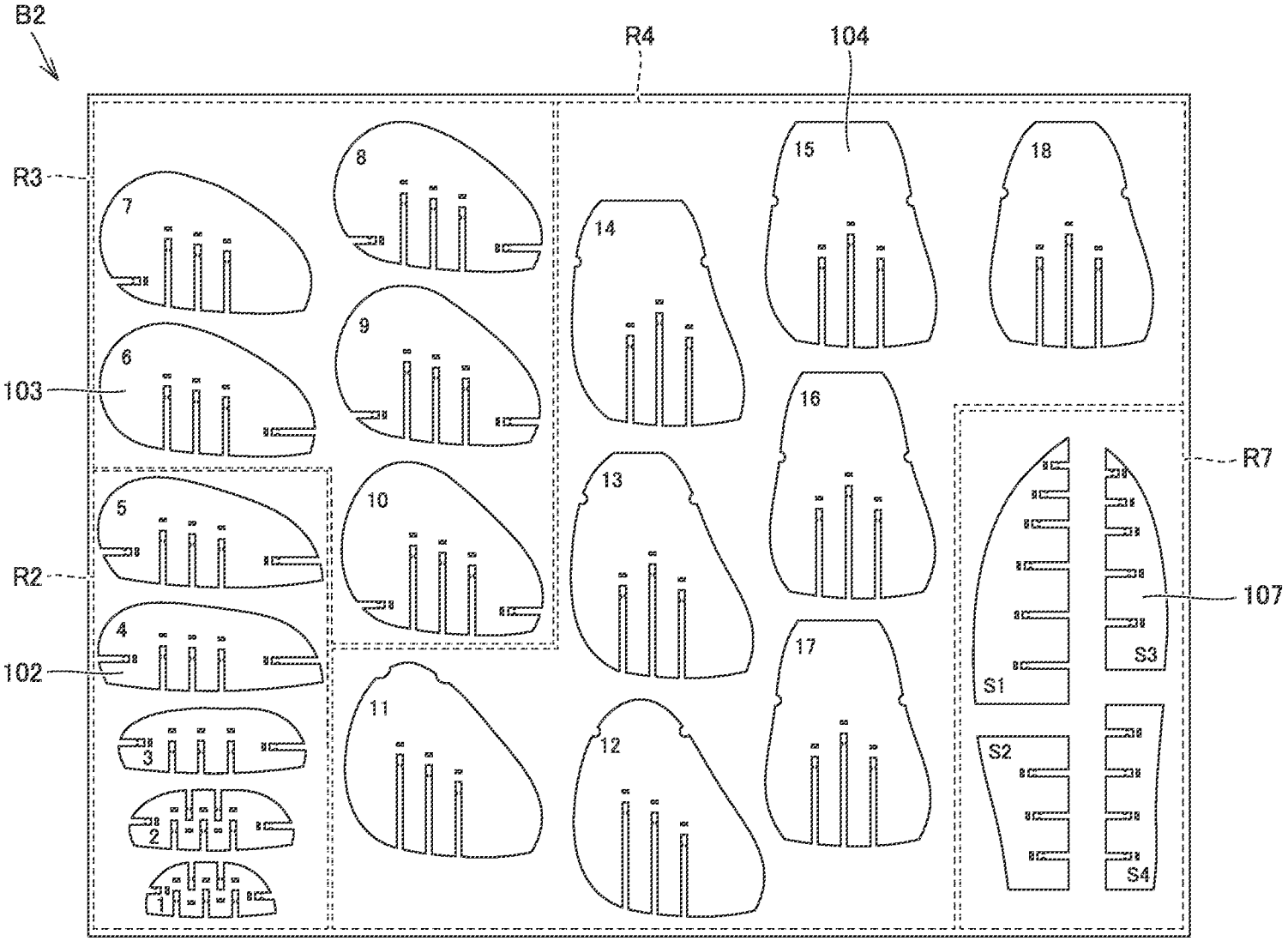
FIG. 9 is a plan view showing, in a visualized manner, a cutting pattern of the wooden board from which the remaining plate-shaped parts included in the last shown in FIG. 7 are cut out.

FIG. 8 is a plan view showing, in a visualized manner, a cutting pattern of a wooden board from which some of the plurality of plate-shaped parts included in the last shown in FIG. 7 are cut out. FIG. 9 is a plan view showing, in a visualized manner, a cutting pattern of the wooden board from which the remaining plate-shaped parts included in the last shown in FIG. 7 are cut out. Referring to FIGS. 8 and 9, the following describes the wooden boards B1 and B2 from which a plurality of plate-shaped parts are cut out.

As shown in FIG. 8, among the above-mentioned plurality of plate-shaped parts, the plurality of foot length direction parts 101, the plurality of circumferential heel parts 105, and the plurality of vertical heel parts 106 are arranged in the wooden board B1. The plurality of foot length direction parts 101, the plurality of circumferential heel parts 105, and the plurality of vertical heel parts 106 are arranged side by side in regions R1, R5, and R6, respectively, defined on the wooden board B1.

As shown in FIG. 9, among the above-mentioned plurality of plate-shaped parts, the plurality of toe parts 102, the plurality of instep parts 103, the plurality of ankle parts 104, and the plurality of laterally extending parts 107 are arranged in the wooden board B2. The plurality of toe parts 102, the plurality of instep parts 103, the plurality of ankle parts 104, and the plurality of laterally extending parts 107 are arranged side by side in regions R2, R3, R4, and R7, respectively, defined on the wooden board B2.

In this case, the wooden boards B1 and B2 are cut, for example, by laser irradiation. By cutting the wooden boards B1 and B2 by such laser irradiation, a plurality of plate-shaped parts can be cut out speedily and accurately. Further, in the case of cutting the wooden boards by laser irradiation, by changing the conditions of laser irradiation, each of the plate-shaped parts to be cut out can be engraved with numerals, alphabets and the like (see FIG. 8 and FIG. 9), which can be used as indicators for assembling the plurality of plate-shaped parts. Note that the method of cutting the wooden boards is not limited to the above-described method, but the wooden boards may be cut with a metal blade, water sprayed with high pressure, or the like.

Further, generation of waste materials can be significantly suppressed by producing the cutting patterns under the condition that the areas of the regions R1 to R7 in which the plate-shaped parts are arranged are minimized in the wooden boards B1 and B2. For example, when standard shoes are manufactured, the cutting patterns are produced so as to satisfy the above-mentioned condition, and thereby, each of the wooden boards B1 and B2 can be reduced in size to 300 mm×450 mm.

As the wooden boards B1 and B2, a medium-density fiberboard (MDF) can be suitably used. The wooden boards B1 and B2 are not limited to such an MDF, but may be an insulation fiberboard (IB), a hard fiberboard (HB), and the like. As an IB, a class-A IB, a tatami board, a sheathing board, and the like can be used. Further, as an HB, a standard board, a tempered board, and the like can be used. Further, in place of the wooden boards B1 and B2, boards made of various materials such as a highly recyclable cardboard, cork, metal, and thermoplastic resin can also be used.

Figure 10:
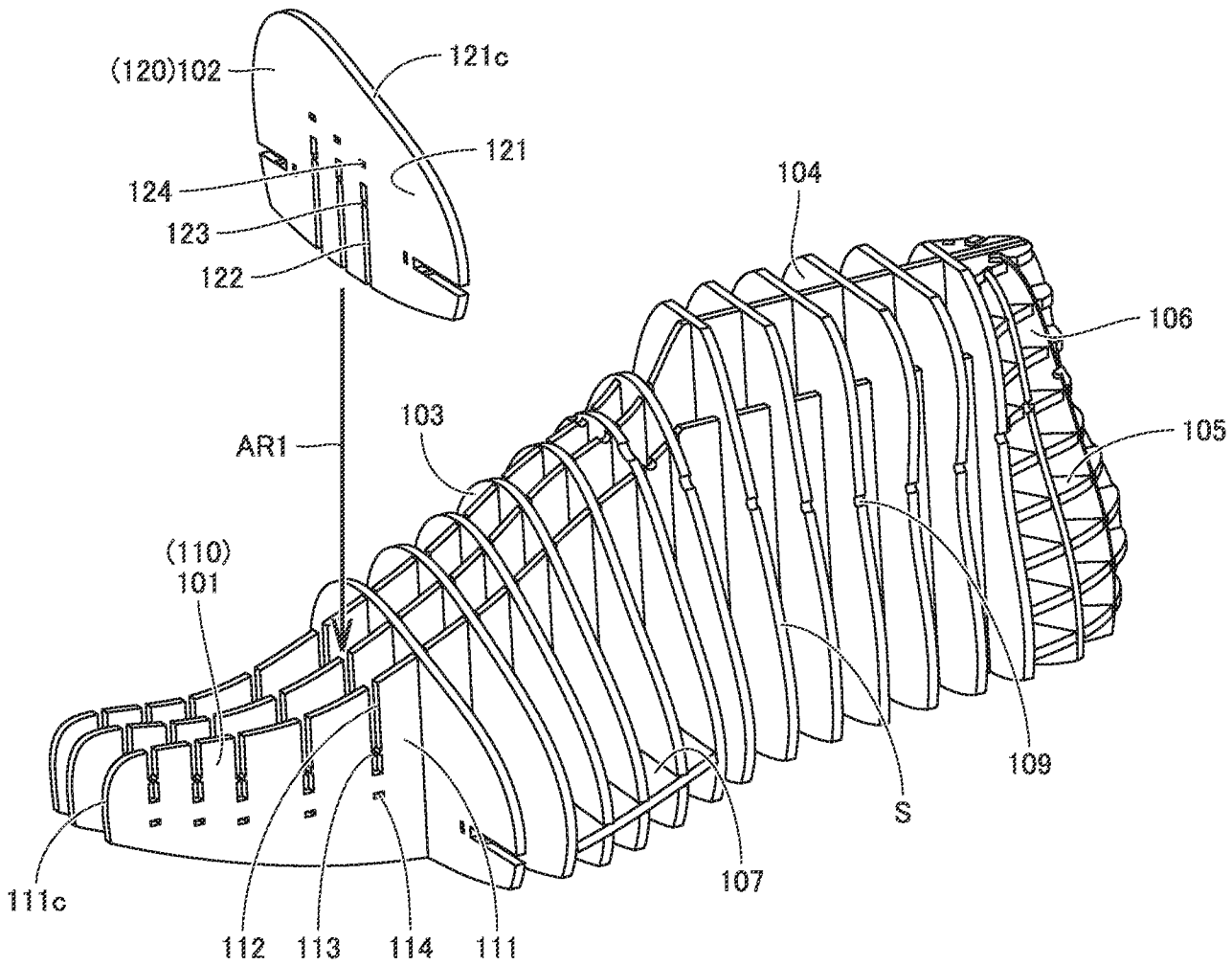
FIG. 10 is a perspective view showing an assembly method for the last shown in FIG. 7.

FIG. 10 is a perspective view showing an assembly method for the last shown in FIG. 7. Referring to FIG. 10, the assembly method for the last 100A according to the present embodiment will be hereinafter described.

As shown in FIG. 10, for assembling the last 100A, a plurality of plate-shaped parts are assembled so as to be sequentially engaged with each other. In the last 100A according to the present embodiment, for example, the plurality of ankle parts 104 are assembled into the longer parts of the plurality of foot length direction parts 101, into which the plate-shaped parts including the plurality of circumferential heel parts 105, the plurality of vertical heel parts 106, the plurality of instep parts 103, the plurality of toe parts 102, the plurality of laterally extending parts 107, and the plurality of foot length direction parts 101 are assembled in ascending order of length.

Thereby, the last 100A shown in FIG. 7 is assembled. In this case, FIG. 10 exemplarily illustrates the state in the middle of assembly and shows the step of assembling one of the plurality of toe parts 102 into the plurality of foot length direction parts 101. Note that the above-described order of assembly is merely by way of example, and the order of assembly can be changed as appropriate.

The plate-shaped parts are assembled using the slits each having a cutout shape, the engaging portions each having a protruding shape, and the to-be-engaged portions each having a through hole shape that are provided as the above-mentioned assembly sections in the respective plate-shaped parts. Specifically, as shown in FIG. 10, for example, in the step of assembling one of the plurality of toe parts 102 into the plurality of foot length direction parts 101, a slit, an engaging portion, and a to-be-engaged portion provided in each of the foot length direction parts 101, and a plurality of slits, a plurality of engaging portions, and a plurality of to-be-engaged portions provided in one of the toe parts 102 are used.

Figure 11:
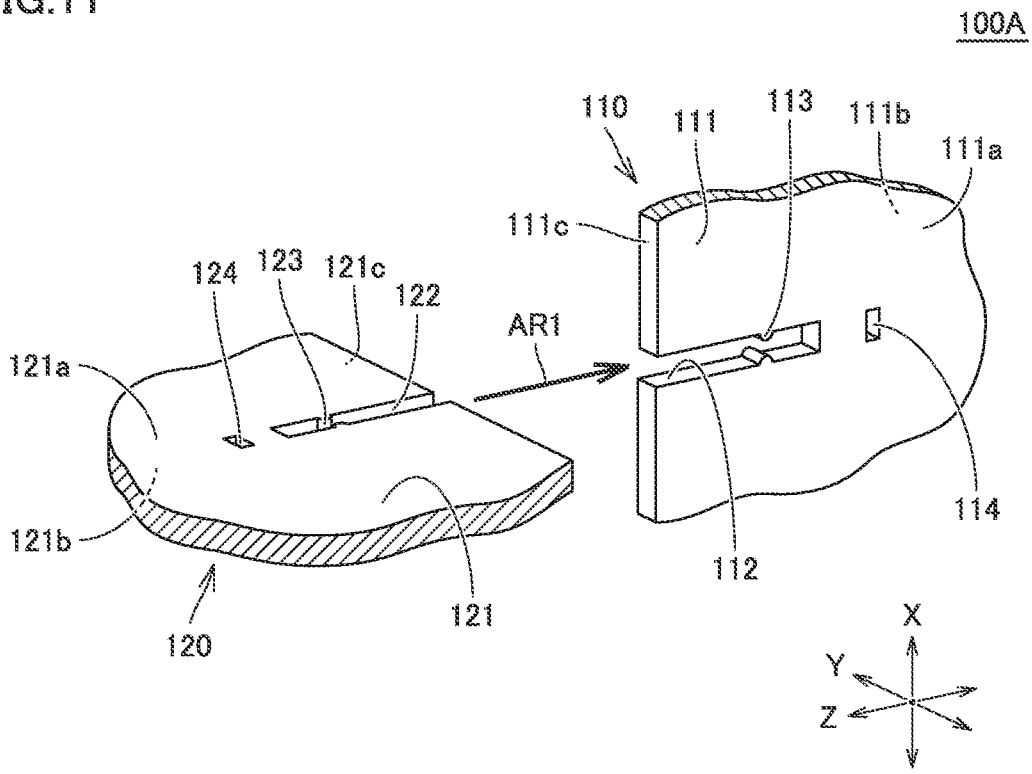
FIG. 11 is a partially cutaway perspective view for illustrating an assembly structure of the plate-shaped parts in the last shown in FIG. 7.
Figure 12:
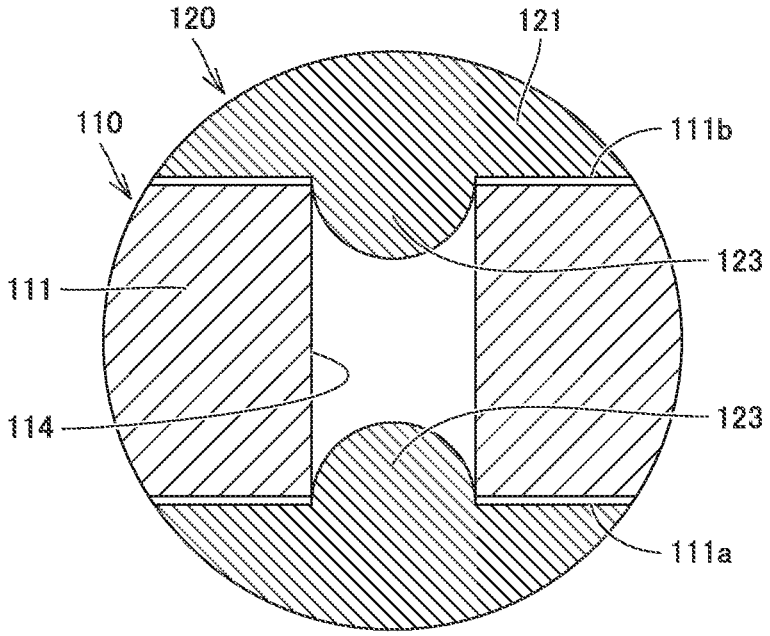
FIG. 12 is a schematic cross-sectional view for illustrating the assembly structure of the plate-shaped parts in the last shown in FIG. 7.

For more specifically explaining the above-described configuration, the following description refers to FIGS. 11 and 12 in addition to the above-mentioned FIG. 10. FIGS. 11 and 12 are a partially cutaway perspective view and a schematic cross-sectional view, respectively, for illustrating the assembly structure of the plate-shaped parts in the last shown in FIG. 7. Note that FIG. 11 shows the state before assembly, and FIG. 12 shows the state after assembly.

In order to facilitate understanding, the following description is given while focusing on the assembly section of one of the above-mentioned plurality of foot length direction parts 101 and the above-mentioned one toe part 102. In the following description, one of the plurality of foot length direction parts 101 is defined as a first part 110 and one toe part 102 is defined as a second part 120.

As shown in FIGS. 10 and 11, the first part 110 includes a first plate-shaped portion 111 having a pair of main surfaces 111*a* and 111*b* and an end surface 111*c*. The first plate-shaped portion 111 is provided with a slit 112 that is a first part-side slit serving as a first part-side receiving portion, a pair of engaging portions 113 each serving as a first part-side engaging portion, and a to-be-engaged portion 114 serving as a first part-side to-be-engaged portion.

The slit 112 is formed in a cutout shape linearly extending so as to reach the end surface 111*c* of the first plate-shaped portion 111. The pair of engaging portions 113 are provided on the inner side surfaces of the first plate-shaped portion 111 in a portion defining the slit 112. Each of the pair of engaging portions 113 has a protruding shape. One and the other of the pair of engaging portions 113 are provided on one and the other of the pair of inner side surfaces such that the pair of engaging portions 113 face each other in the direction intersecting with the extending direction of the slit 112. The pair of engaging portions 113 each have a semi-cylindrical shape.

The to-be-engaged portion 114 is formed in a through hole shape, and provided in the first plate-shaped portion 111 so as to reach the pair of main surfaces 111*a* and 111*b* of the first plate-shaped portion 111. The to-be-engaged portion 114 is located on the line extending in the extending direction of the slit 112. The to-be-engaged portion 114 is rectangular in a plan view.

On the other hand, the second part 120 includes a second plate-shaped portion 121 having a pair of main surfaces 121*a* and 121*b* and an end surface 121*c*. The second plate-shaped portion 121 is provided with a slit 122 that is a second part-side slit serving as a second part-side receiving portion, a pair of engaging portions 123 each serving as a second part-side engaging portion, and a to-be-engaged portion 124 serving as a second part-side to-be-engaged portion.

The slit 122 is formed in a cutout shape linearly extending so as to reach the end surface 121*c* of the second plate-shaped portion 121. The pair of engaging portions 123 are provided on the inner side surfaces of the second plate-shaped portion 121 in a portion defining the slit 122. Each of the pair of engaging portions 123 has a protruding shape. One and the other of the pair of engaging portions 123 are provided on one and the other of the pair of inner side surfaces such that the pair of engaging portions 123 face each other in the direction intersecting with the extending direction of the slit 122. The pair of engaging portions 123 each have a semi-cylindrical shape.

The to-be-engaged portion 124 is formed in a through hole shape and provided in the second plate-shaped portion 121 so as to reach the pair of main surfaces 121*a* and 121*b* of the second plate-shaped portion 121. The to-be-engaged portion 124 is located on the line extending in the extending direction of the slit 122. The to-be-engaged portion 124 is rectangular in a plan view.

When the first part 110 and the second part 120 are assembled, the first plate-shaped portion 111 of the first part 110 and the second plate-shaped portion 121 of the second part 120 are directed so as to intersect with each other, and positioned such that the slit 122 provided in the second part 120 is located at a position corresponding to the slit 112 provided in the first part 110. Then, in this state, the second part 120 is pushed into the first part 110 in the direction indicated by an arrow AR1 shown in the figure.

Thereby, the first plate-shaped portion 111 of the first part 110 is received in the slit 122 provided in the second part 120, and the second plate-shaped portion 121 of the second part 120 is received in the slit 112 provided in the first part 110, with the result that the first plate-shaped portion 111 and the second plate-shaped portion 121 are engaged with each other.

At this time, the first plate-shaped portion 111 is inserted into the slit 122, and thereby, not only the first plate-shaped portion 111 is fitted into the slit 122, but also the pair of engaging portions 123 each having a protruding shape and provided in the second part 120 are further fitted into the to-be-engaged portion 114 having a through hole shape and provided in the first part 110 as shown in FIG. 12. Accordingly, the to-be-engaged portion 114 is engaged by the pair of engaging portions 123.

At this time, a portion of the to-be-engaged portion 114 that is exposed in one of the pair of main surfaces 111*a* and 111*b* of the first plate-shaped portion 111 is engaged by one of the pair of engaging portions 123, and a portion of the to-be-engaged portion 114 that is exposed in the other of the pair of main surfaces 111*a* and 111*b* of the first plate-shaped portion 111 is engaged by the other of the pair of engaging portions 123.

In addition, the second plate-shaped portion 121 is inserted into the slit 112, and thereby, not only the second plate-shaped portion 121 is fitted into the slit 112, but also the pair of engaging portions 113 each having a protruding shape and provided in the first part 110 are fitted into the to-be-engaged portion 124 having a through hole shape and provided in the second part 120 (not shown). Thus, the to-be-engaged portion 124 is engaged by the pair of engaging portions 113.

At this time, a portion of the to-be-engaged portion 124 that is exposed in one of the pair of main surfaces 121*a* and 121*b* of the second plate-shaped portion 121 is engaged by one of the pair of engaging portions 113, and a portion of the to-be-engaged portion 124 that is exposed in the other of the pair of main surfaces 121*a* and 121*b* of the second plate-shaped portion 121 is engaged by the other of the pair of engaging portions 113.

In addition, the first plate-shaped portion 111 and the second plate-shaped portion 121 may be fitted into the slit 122 and the slit 112, respectively, so as to be in close contact with each other, or so as to provide a slight clearance therebetween in order to facilitate insertion or in consideration of errors in dimensional accuracy.

By the configuration as described above, the first plate-shaped portion 111 is fitted into the slit 122, so that the first part 110 and the second part 120 are fixed in a Y-axis direction shown in FIG. 11, and the second plate-shaped portion 121 is fitted into the slit 112, so that the first part 110 and the second part 120 are fixed in an X-axis direction shown in FIG. 11. Also, the to-be-engaged portion 114 is engaged by the engaging portion 123, so that the first part 110 and the second part 120 are fixed in the X-axis direction and a Z-axis direction shown in FIG. 11, and the to-be-engaged portion 124 is engaged by the engaging portion 113, so that the first part 110 and the second part 120 are fixed in the Y-axis direction and the Z-axis direction shown in FIG. 11.

Thus, by employing the above-described configuration, the first part 110 and the second part 120 can be firmly fixed to each other in a simple operation of positioning the first part 110 and the second part 120 and then pushing the second part 120 into the first part 110. In the last 100A according to the present embodiment, the above-described assembly structure is applied to each of the assembly sections for all the plate-shaped parts included in the last 100A.

Therefore, by the configuration as described above, the plurality of plate-shaped parts included in the last 100A can be easily and reliably fixed, and the last having such mechanical strength as preventing easy disengagement of these plate-shaped parts can be speedily and simply fabricated.

Also, as described above, the last 100A according to the present embodiment can be speedily and simply fabricated, and therefore, for example, a wearer himself/herself can also experience such a speedy and simple fabrication. In other words, by way of example, the wearer himself/herself can also experience the operation of photographing the wearer's foot F in a store visited by the wearer to obtain image data, producing the last model LM based on the image data, fabricating a plurality of plate-shaped parts based on the last model LM, and then, by the wearer himself/herself, assembling the plurality of plate-shaped parts to fabricate the last 100A.

In this case, as shown in FIG. 7, in the last 100A according to the present embodiment, the recessed portions 109 are provided at prescribed positions in the last 100A as described above. The recessed portions 109 each are located in a specific region of the forming surface S that is a region corresponding to the upper end portion of a to-be-formed portion of the upper 30 of the shoe 1 to be manufactured. In the present embodiment, the above-mentioned upper end portion (the portion indicated by a reference character UP in FIGS. 1 and 2) of the shoe 1 to be manufactured is a portion along which the topline 31 is formed. Thus, the above-mentioned specific region of the forming surface S corresponds to the topline 31.

Specifically, the recessed portions 109 each are formed by cutting out a part of the end portion of the plate-shaped part disposed at a position corresponding to the specific region, and are provided entirely in a loop shape. More specifically, in the last 100A according to the present embodiment, the recessed portion 109 is provided in each of the longer parts of the plurality of foot length direction parts 101, the plurality of ankle parts 104, some of the plurality of circumferential heel parts 105, and the plurality of vertical heel parts 106.

The configuration as described above allows the recessed portion 109 to be used as a mark when the upper 30 is formed.

In other words, the last 100A according to the present embodiment is formed by combining a plurality of plate-shaped parts, so that a plurality of gaps (i.e., portions where no plate-shaped part is disposed) are provided in the forming surface S. Thus, in the case where no measures are taken, the upper forming material cannot be easily aligned.

However, as described above, the specific region of the forming surface S is provided with the recessed portions 109 entirely formed in a loop shape and corresponding to the topline 31. Thereby, when the upper forming material is overlaid on the last 100A, the upper end portion of the upper forming material is disposed to overlap with the recessed portions 109, so that the upper forming material can be aligned with respect to the last 100A.

Therefore, according to the last 100A of the present embodiment, the upper 30 can be easily aligned during forming of the upper 30, and thereby, not only the finished quality of the shoe 1 to be manufactured is improved but also the productivity is significantly improved.

Second Embodiment

Figure 13B:
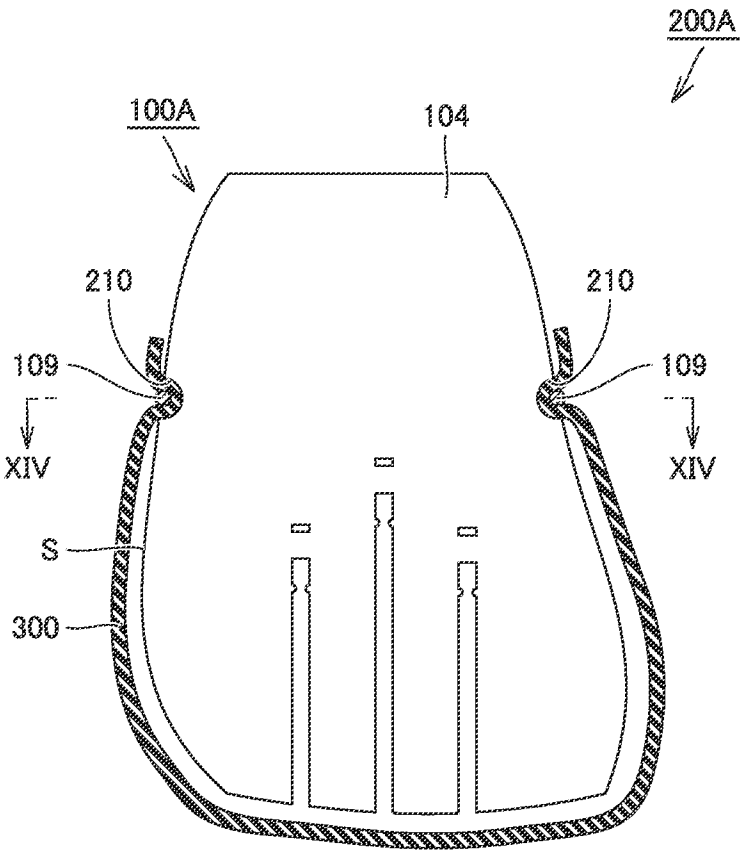
FIGS. 13A and 13B each are a diagram for illustrating a shoe upper forming tool according to a second embodiment.
Figure 13A:
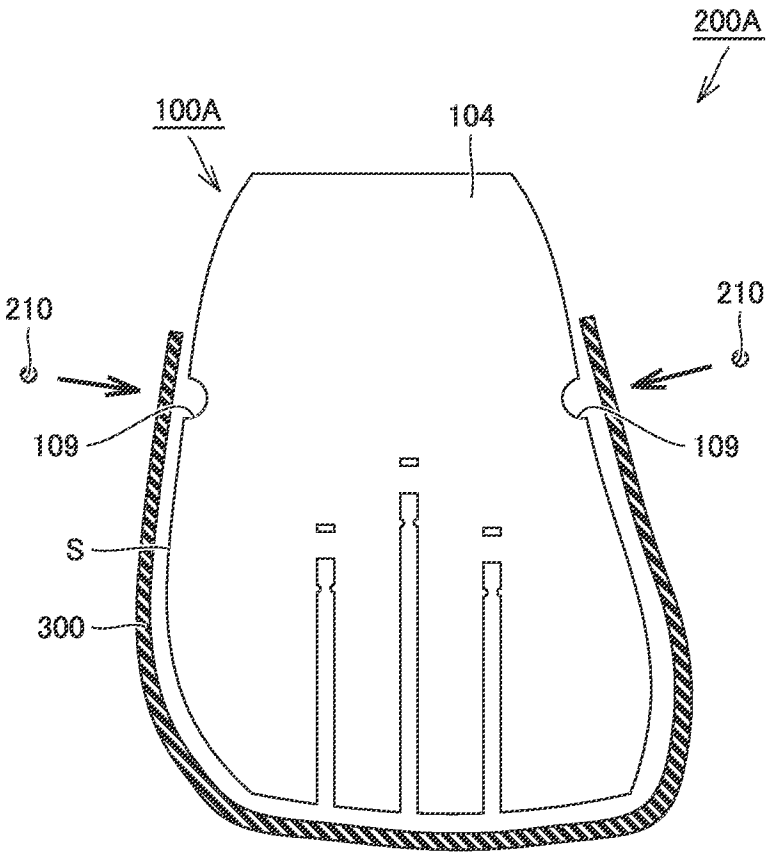
Figure 14:
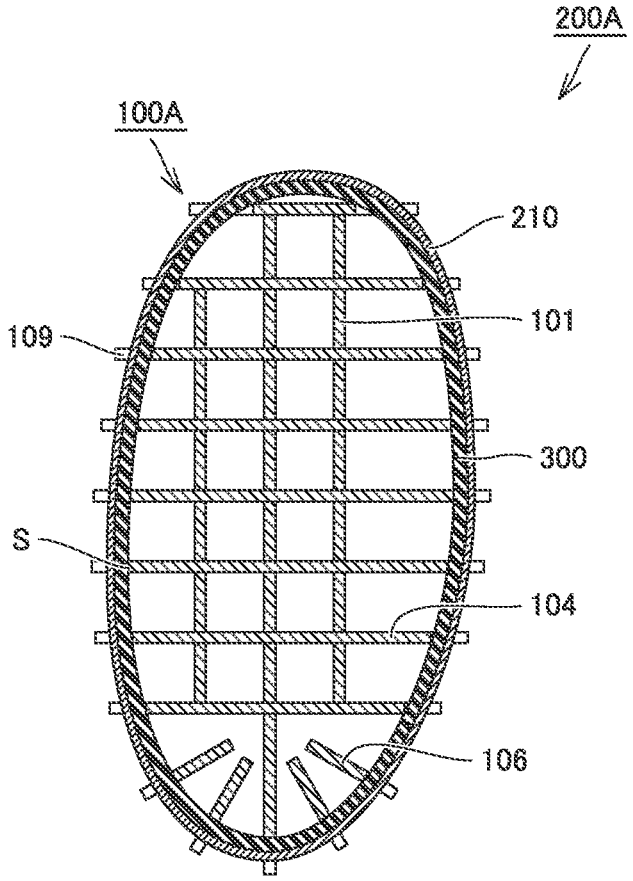
FIG. 14 is a schematic cross-sectional view showing a state in which a shoe upper is held by the shoe upper forming tool according to the second embodiment.

FIGS. 13A and 13B each are a diagram for illustrating a shoe upper forming tool according to the second embodiment, and FIG. 14 is a schematic cross-sectional view showing the state in which a shoe upper is held by the shoe upper forming tool. Referring to FIGS. 13A, 13B, and 14, a shoe upper forming tool 200A according to the present embodiment will be hereinafter described. FIGS. 13A and 13B are diagrams showing, in a stepwise manner, the state in which an upper forming material 300 is overlaid on the last 100A included in the shoe upper forming tool 200A. FIG. 14 shows a cross section taken along a line XIV-XIV shown in FIG. 13B.

As shown in FIGS. 13A, 13B, and 14, the shoe upper forming tool 200A includes the above-mentioned last 100A according to the first embodiment and a band 210 as a string-shaped fixing member. The band 210 serves to sandwich and hold the upper forming material 300 (after forming, the upper 30) between the band 210 and the last 100A, and is formed of a loop-shaped member, for example, made of resin or rubber and having heat resistance and elasticity. On the other hand, the upper forming material 300 has a bag-like shape having an upper end opening.

As shown in FIG. 13A, when the upper 30 is formed, the upper forming material 300 is first overlaid so as to cover the bottom surface of the last 100A and the portion of the circumferential surface of the last 100A that is located on the bottom surface side. More specifically, the last 100A is inserted into the bag-shaped upper forming material 300 through an opening provided at the upper end of the upper forming material 300, so that the forming surface S of the last 100A is covered with the upper forming material 300.

At this time, the upper end portion of the upper forming material 300 overlaid on the last 100A is disposed so as to cover each recessed portion 109 provided in the last 100A. FIG. 13A illustrating this state shows only one ankle part 104 of the last 100A for facilitating understanding.

Then, as shown in FIGS. 13A, 13B, and 14, from outside, the band 210 is fitted over the upper end portion of the upper forming material 300. At this time, external force is applied to the band 210, so that the band 210 is elastically deformed to be expanded outward, and then, placed to surround the upper end portion of the upper forming material 300. Then, when external force is no longer applied, the band 210 is contracted and thereby fitted over the upper end portion of the upper forming material 300.

At this time, the contracted band 210 is fitted into the recessed portion 109 provided in the last 100A such that a part of the upper end portion of the upper forming material 300 is get caught therebetween. Thereby, the upper end portion of the upper forming material 300 is sandwiched and held between the recessed portion 109 and the band 210. When the band 210 is fitted into the recessed portion 109, the position of the upper forming material 300 is adjusted based on the recessed portion 109 as a mark for alignment. Note that FIG. 13B illustrating this state shows only one ankle part 104 of the last 100A for facilitating understanding.

In this way, positioning of the upper forming material 300 with respect to the last 100A completes, and then, the above-described heating treatment or the like is performed, with the result that the upper 30 is formed.

In this case, in order to allow the above-described positioning operation, in the shoe upper forming tool 200A according to the present embodiment, each recessed portion 109 provided in the last 100A is shaped and sized to be capable of accommodating at least a part of the band 210 such that the upper forming material 300 can be sandwiched and held between the recessed portion 109 and the band 210.

Therefore, by the configuration as described above, the upper 30 can be easily aligned during forming of the upper 30, and thus, not only the finished quality of the shoe 1 to be manufactured is improved but also the productivity is significantly improved.

Third Embodiment

Figure 15:
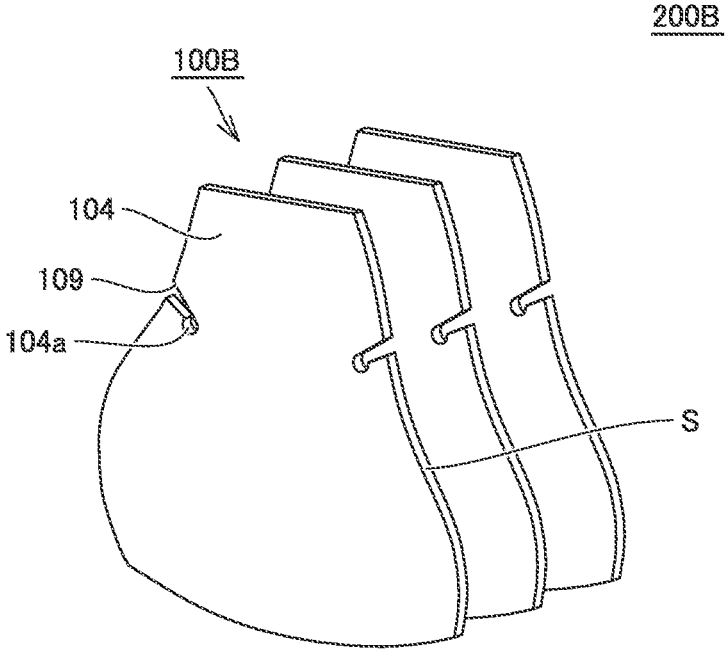
FIG. 15 is a diagram for illustrating a shoe upper forming tool according to a third embodiment.
Figure 16:
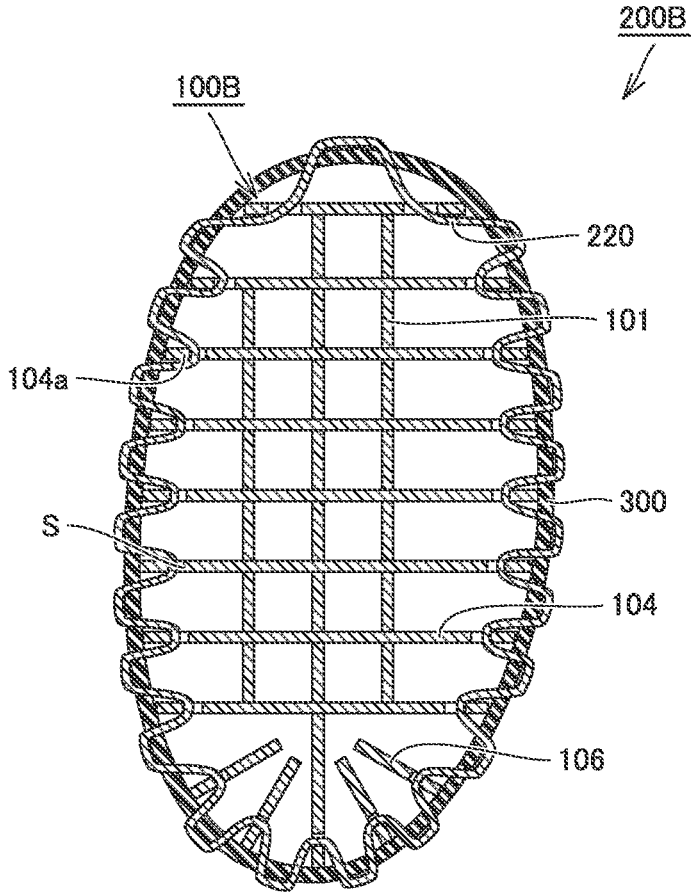
FIG. 16 is a schematic cross-sectional view showing a state in which a shoe upper is held by the shoe upper forming tool according to the third embodiment.

FIG. 15 is a diagram for illustrating a shoe upper forming tool according to a third embodiment. FIG. 16 is a schematic cross-sectional view showing the state in which a shoe upper is held by the shoe upper forming tool. Referring to FIGS. 15 and 16, a shoe upper forming tool 200B according to the present embodiment will be hereinafter described. Note that FIG. 16 shows a cross section of a portion including a retaining portion 104*a* (described later) provided in the recessed portion 109 in the state in which the upper forming material 300 is overlaid on the last 100B included in the shoe upper forming tool 200B.

As shown in FIGS. 15 and 16, the shoe upper forming tool 200B includes the last 100B having a configuration similar to that of the last 100A according to the above-described first embodiment, and a wire 220 as a string-shaped fixing member. Note that FIG. 15 shows only three ankle parts 104 of the last 100B for facilitating understanding.

The last 100B is different from the last 100A according to the above-described first embodiment only in the shape of the recessed portion 109 provided at the end portion of each plate-shaped part. Specifically, as shown in FIG. 15, the recessed portion 109 has a shape obtained by cutting an end portion of each ankle part 104 as a plate-shaped part into a substantially L-shape in a plan view. Thereby, the ankle part 104 is provided with a retaining portion 104*a* having a protruding shape.

On the other hand, as shown in FIG. 16, the wire 220 can be sewn into the upper forming material 300 so as to penetrate through the upper forming material 300, and is formed of a heat-resistant member, for example, made of resin or metal.

As shown in FIG. 16, the wire 220 is sewn into the upper end portion of the upper forming material 300 at prescribed positions so as to extend in a slack state in the circumferential direction of the upper end portion. In other words, the wire 220 is sewn into the upper end portion of the upper forming material 300 in the circumferential direction of the upper end portion so as to penetrate through the upper end portion alternately to the inner circumferential surface side and the outer circumferential surface side. Further, particularly on the inner circumferential surface side of the upper end portion of the upper forming material 300, the wire 220 is loosened so as to provide a gap between the inner circumferential surface and a portion of the wire 220 that protrudes from the inner circumferential surface. The wire 220 is sewn into the upper forming material 300 before the upper forming material 300 is overlaid on the last 100B.

The upper forming material 300 into which the wire 220 is sewn in this way is then overlaid on the last 100B. At this time, the loosened portion of the wire 220 is fitted into the recessed portion 109 provided in the last 100A. Further, at this time, the loosened portion of the wire 220 is hooked into the above-mentioned retaining portion 104*a* provided in the ankle part 104 as the plate-shaped part. At this time, the circumferential length of the wire 220 is appropriately adjusted in advance to thereby make it possible to prevent slack or wrinkles in a portion of the upper forming material 300 that covers the last 100B.

Thus, by appropriately adjusting the positions at which the wire 220 is sewn into the upper forming material 300, the positioning of the upper forming material 300 with respect to the last 100B is completed by performing the above-described operation. Then, the above-described heat treatment or the like is performed to thereby form the upper 30. After the upper 30 is formed, the wire 220 is removed from the upper 30.

In this case, in order to allow the above-described positioning operation, in the shoe upper forming tool 200B according to the present embodiment, the recessed portion 109 is shaped and sized to be capable of retaining the wire 220 accommodated in the recessed portion 109.

Therefore, by the configuration as described above, the upper 30 can be easily aligned during forming of the upper 30, and thus, not only the finished quality of the shoe 1 to be manufactured is improved but also the productivity is significantly improved.

Fourth Embodiment

Figure 17:
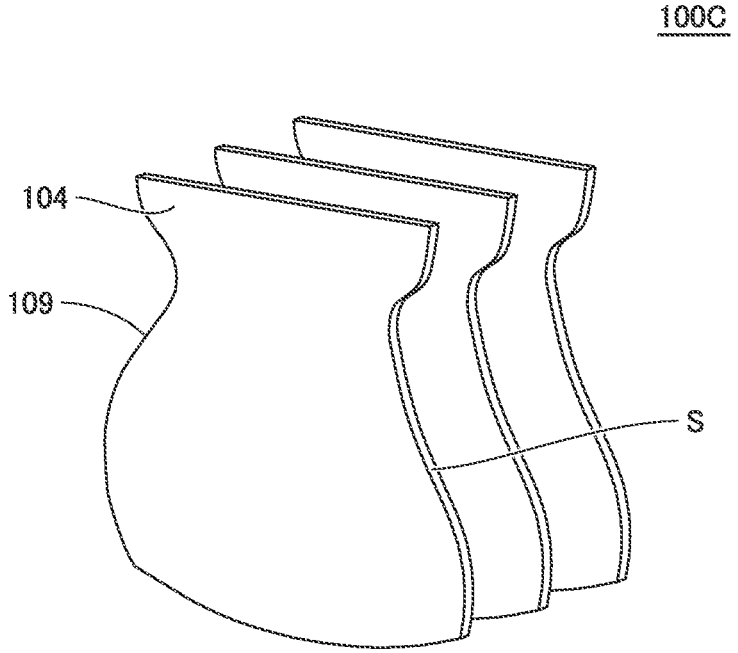
FIG. 17 is a diagram for illustrating a last according to a fourth embodiment.
Figure 18:
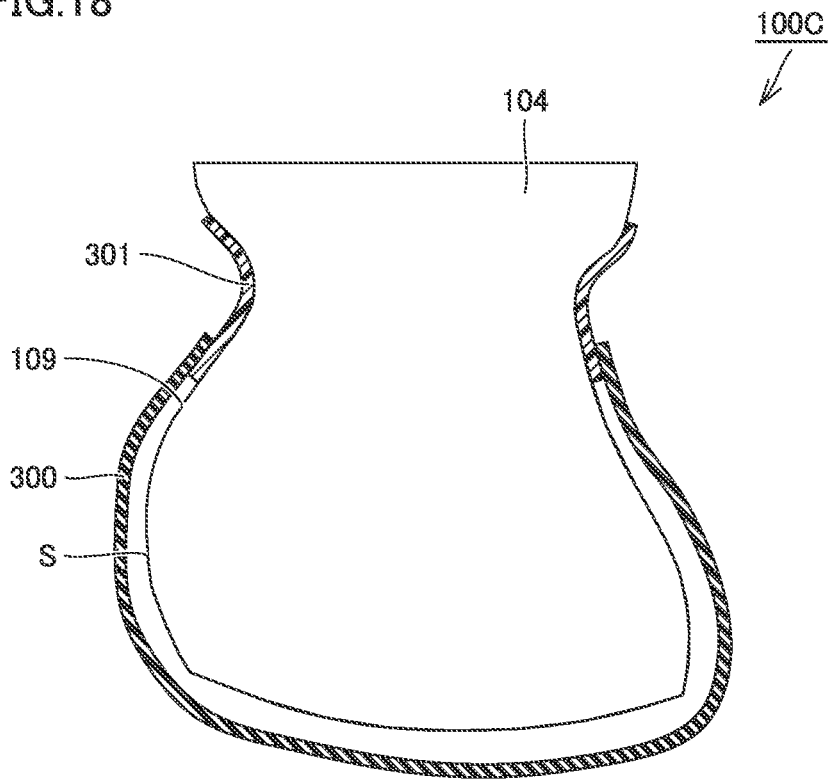
FIG. 18 is a schematic cross-sectional view showing a state in which a shoe upper is held by the last according to the fourth embodiment.

FIG. 17 is a diagram for illustrating a last according to the fourth embodiment. FIG. 18 is a schematic cross-sectional view showing the state in which a shoe upper is held by the last. Referring to FIGS. 17 and 18, a last 100C according to the present embodiment will be hereinafter described.

As shown in FIG. 17, the last 100C according to the present embodiment is different from the last 100A according to the first embodiment only in the shape of the recessed portion 109 provided at the end portion of the plate-shaped part. Specifically, the recessed portion 109 is shaped to be smoothly narrowed as compared with the circumference of the ankle part 104 formed as a plate-shaped part. Note that FIG. 17 shows only three ankle parts 104 of the last 100B for facilitating understanding.

As shown in FIG. 18, an elastic material 301 is sewn onto the upper end portion of the upper forming material 300, which is then overlaid on the last 100C configured as described above. The elastic material 301 is formed of a sheet-like member, for example, made of resin or rubber and having heat resistance and elasticity. Note that the elastic material 301 may constitute a part of the upper 30, or may be removed after the upper 30 is formed.

When the upper forming material 300 is overlaid on the last 100C, external force is applied to the elastic material 301, so that the elastic material 301 is elastically deformed to be expanded outward, and then, placed to surround the recessed portions 109 of the last 100C. Then, when external force is no longer applied, the elastic material 301 is contracted, so that the elastic material 301 and the upper end portion of the upper forming material 300 are fitted into the recessed portions 109. Note that FIG. 18 shows only one ankle part 104 of the last 100C for facilitating understanding.

In such a configuration, the upper forming material 300 is overlaid on the last 100C based on the above-described recessed portion 109 as a mark, and thus, positioning of the upper forming material 300 with respect to the last 100C is completed. Then, the above-described heat treatment or the like is performed to thereby form the upper 30.

Therefore, also by the configuration as described above, the upper 30 can be easily aligned during forming of the upper 30, and thus, not only the finished quality of the shoe 1 to be manufactured is improved but also the productivity is significantly improved.

Fifth Embodiment

Figure 19:
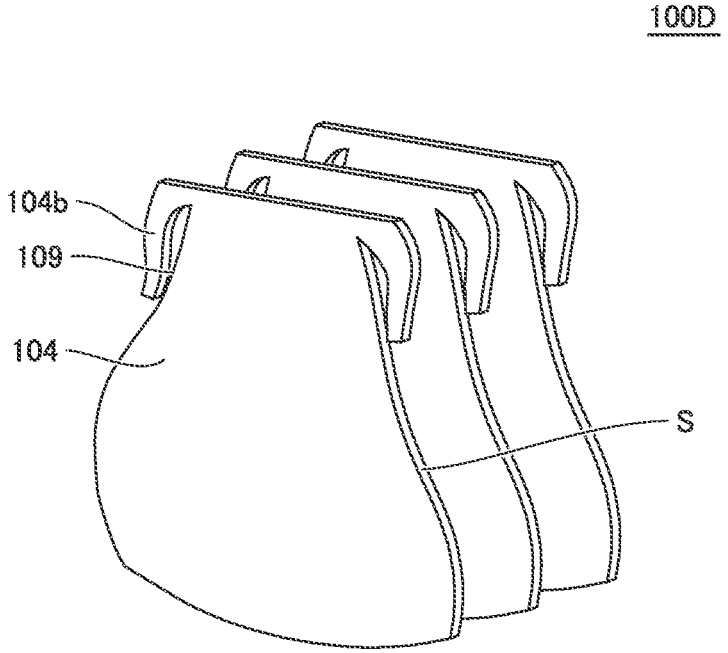
FIG. 19 is a diagram for illustrating a last according to a fifth embodiment.
Figure 20:
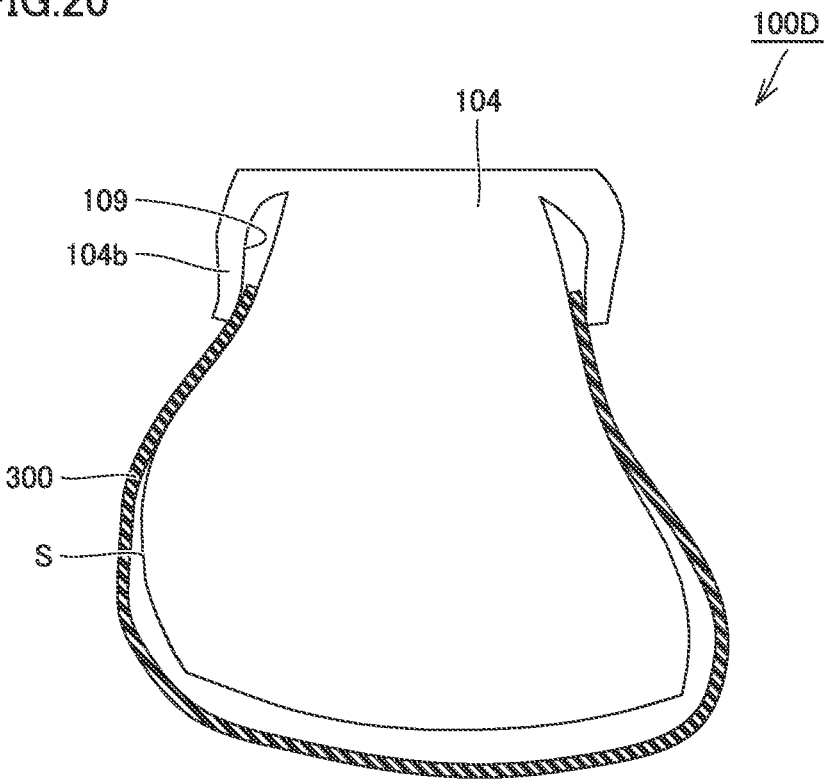
FIG. 20 is a schematic cross-sectional view showing a state in which a shoe upper is held by the last according to the fifth embodiment.

FIG. 19 is a diagram for illustrating a last according to the fifth embodiment. FIG. 20 is a schematic cross-sectional view showing the state in which a shoe upper is held by the last. Referring to FIGS. 19 and 20, a last 100D according to the present embodiment will be hereinafter described.

As shown in FIG. 19, the last 100D according to the present embodiment is different from the last 100A according to the first embodiment only in the shape of the recessed portion 109 provided at the end portion of each plate-shaped part. Specifically, the recessed portion 109 is formed at the end portion in the width direction of the ankle part 104 as a plate-shaped part such that it is smoothly cut from the lower end side toward the upper end side. Thereby, an engagement piece 104*b* having a hook shape is provided at the end portion of the ankle part 104. Note that FIG. 19 shows only three ankle parts 104 of the last 100D for facilitating understanding.

As shown in FIG. 20, when the upper forming material 300 is overlaid on the last 100D, the upper end portion of the upper forming material 300 is inserted into the recessed portion 109 provided in the last 100D. Thereby, the portion of the upper forming material 300 that is inserted into the recessed portion 109 is sandwiched and held by the portions of the wall that define the recessed portion 109 of the last 100D (i.e., between the above-mentioned engagement piece 104*b* and the portion of the wall that faces the engagement piece 104*b*). Note that FIG. 20 shows only one ankle part 104 of the last 100D for facilitating understanding.

In such a configuration, the upper forming material 300 is overlaid on the last 100D based on the above-described recessed portion 109 as a mark, and thus, positioning of the upper forming material 300 with respect to the last 100D is completed. Then, the above-described heat treatment or the like is performed to thereby form the upper 30.

In this case, in order to allow the above-described positioning operation, in the last 100D according to the present embodiment, the end portions of the plurality of plate-shaped parts are provided with the recessed portions 109 that each are configured to define a sandwiching portion for holding the upper forming material 300.

Therefore, by the configuration as described above, the upper 30 can be easily aligned during forming of the upper 30, and thus, not only the finished quality of the shoe 1 to be manufactured is improved but also the productivity is significantly improved.

Sixth Embodiment

Figure 21:
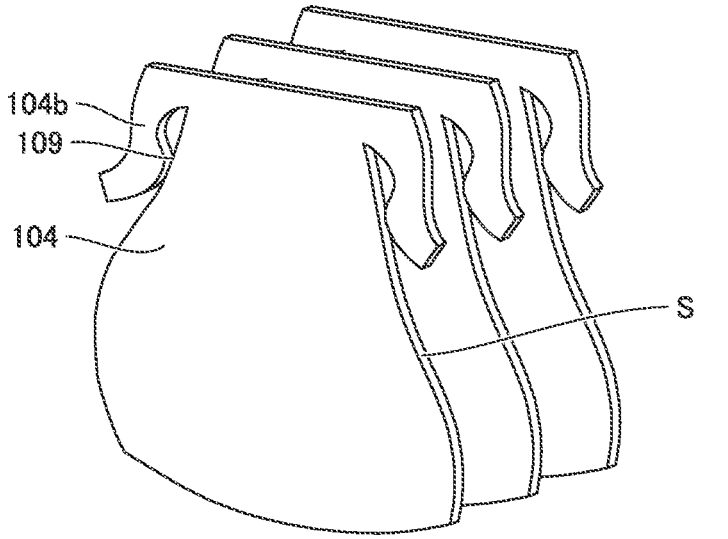
FIG. 21 is a diagram for illustrating a last according to a sixth embodiment.
Figure 22:
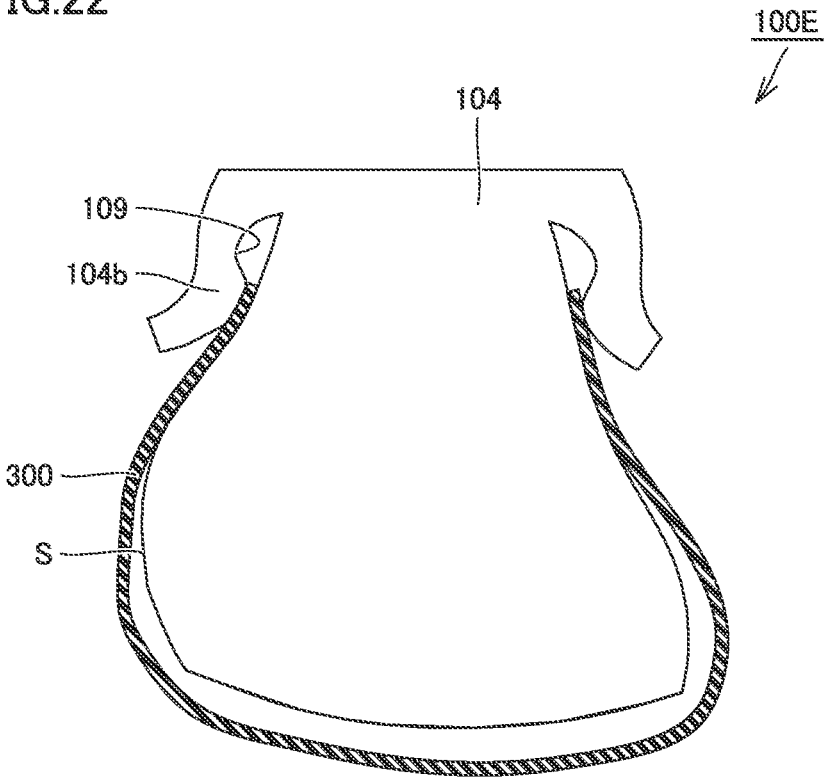
FIG. 22 is a schematic cross-sectional view showing a state in which a shoe upper is held by the last according to the sixth embodiment.

FIG. 21 is a diagram for illustrating a last according to the sixth embodiment. FIG. 22 is a schematic cross-sectional view showing the state in which a shoe upper is held by the last. Referring to FIGS. 21 and 22, a last 100E according to the present embodiment will be hereinafter described.

As shown in FIG. 21, the last 100E according to the present embodiment is different from the last 100D according to the fifth embodiment only in the shape of the engagement piece 104*b* provided at the end portion of each plate-shaped part. In other words, the engagement piece 104*b* is configured such that its distal end protrudes outward, and the portion of the engagement piece 104*b* that faces the recessed portion 109 has a curved surface shape.

In the last 100E configured as described above, as shown in FIG. 22, when the upper forming material 300 is inserted into the recessed portion 109 of the last 100E, the upper forming material 300 is prevented from coming into contact with the pointed tip end of the engagement piece 104*b*. Also, in the state in which the upper forming material 300 is held by the last 100E, the upper forming material 300 is held not by the pointed tip end of the engagement piece 104*b* but by the curved surface portion.

Therefore, the configuration as described above can achieve not only the effect described in the above fifth embodiment, but also the effect of allowing suppression of damage or fraying of the upper forming material 300 and the upper 30.

Seventh Embodiment

Figure 23:
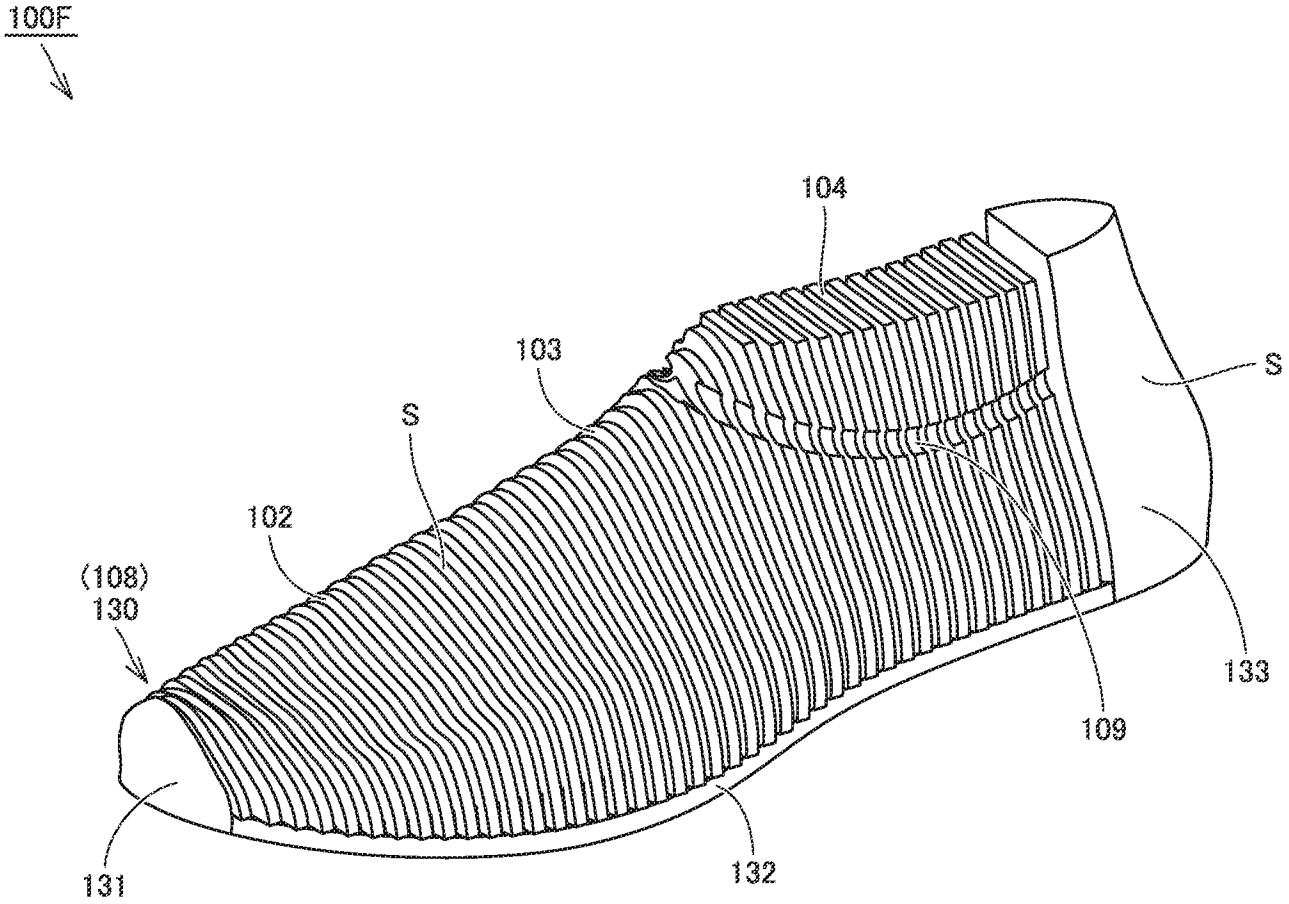
FIG. 23 is a perspective view of a last according to a seventh embodiment.

FIG. 23 is a perspective view of a last according to the seventh embodiment. Referring to FIG. 23, a last 100F according to the present embodiment will be hereinafter described. Note that the last 100F according to the present embodiment is fabricated according to the above-described method of producing a last model and basically conforms to the shape of a wearer's foot.

As shown in FIG. 23, the last 100F is the same as the last 100A according to the above-described first embodiment in that the last 100F is formed by combining a plurality of last forming parts but is different from the last 100A in the configuration in which the plurality of last forming parts include a block-shaped part in addition to the plurality of plate-shaped parts. More specifically, the plurality of last forming parts include a base part 108 as a block-shaped part, and a plurality of toe parts 102, a plurality of instep parts 103, and a plurality of ankle parts 104 as plate-shaped parts.

The base part 108 includes: a front end-side toe portion 131 corresponding to the front end of the wearer's toe; a foot sole portion 132 corresponding to the foot sole located at positions from the rear end of the wearer's toe to the front end of the wearer's heel; and a rear end-side heel portion 133 corresponding to the rear end of the wearer's heel.

In this case, the base part 108 serves as a base frame to which the above-described plurality of plate-shaped parts are assembled, and defines the bottom surface of the last 100F. The base part 108 may be made, for example, of resin, metal, wood, or the like, and are preferably made of hard resin.

On the other hand, the plurality of toe parts 102, the plurality of instep parts 103, and the plurality of ankle parts 104 have basically the same configurations as those in the last 100A according to the above-described first embodiment, and each are formed of a wooden board. In this case, the plurality of toe parts 102, the plurality of instep parts 103, and the plurality of ankle parts 104 are arranged in a multilayered manner in the front-rear direction (i.e., in the foot length direction).

The base part 108, the plurality of toe parts 102, the plurality of instep parts 103, and the plurality of ankle parts 104 are combined to define a forming surface S of the last 100F. More specifically, the outer surface of the base part 108 defines the forming surface S of the last 100F. Also, the end surfaces of the plurality of toe parts 102, the plurality of instep parts 103, and the plurality of ankle parts 104 (i.e., the surfaces extending in the thickness direction of the plate-shaped parts) define the forming surface S of the last 100F.

In this case, the portion of the forming surface S that is defined by the base part 108 corresponds to a portion of the entire outer surface of the foot that is less likely to be different in shape for each wearer. On the other hand, the portion of the forming surface S that is defined by each of the plurality of toe parts 102, the plurality of instep parts 103, and the plurality of ankle parts 104 corresponds to a portion of the entire outer surface of the foot that is more likely to be different in shape for each wearer.

Thus, in the case where the last 100F is configured by combining the base part 108 as a block-shaped part with the plurality of toe parts 102, the plurality of instep parts 103, and the plurality of ankle parts 104 as a plurality of plate-shaped parts in this way, the last can be more efficiently fabricated by preparing the base part 108 in advance for each size of the shoe to be manufactured.

In this case, in the last 100F according to the present embodiment, the recessed portions 109 are provided at prescribed positions of the last 100F. Each of the recessed portions 109 is located in a specific region of the forming surface S that corresponds to the upper end portion of the to-be-formed portion of the upper 30 of the shoe 1 to be manufactured. In the present embodiment, the above-mentioned upper end portion of the shoe 1 to be manufactured (the portion indicated by the reference character UP in FIGS. 1 and 2) is provided with a topline 31. Accordingly, the above-mentioned specific region of the forming surface S is a region corresponding to the topline 31. Specifically, the recessed portion 109 is provided in each of the plurality of ankle parts 104.

Therefore, also in the configuration as described above, each recessed portion 109 can be used as a mark when the upper 30 is formed. Accordingly, the upper 30 can be easily aligned during forming of the upper 30, and thus, not only the finished quality of the shoe 1 to be manufactured is improved but also the productivity is significantly improved.

Eighth Embodiment

Figure 24:
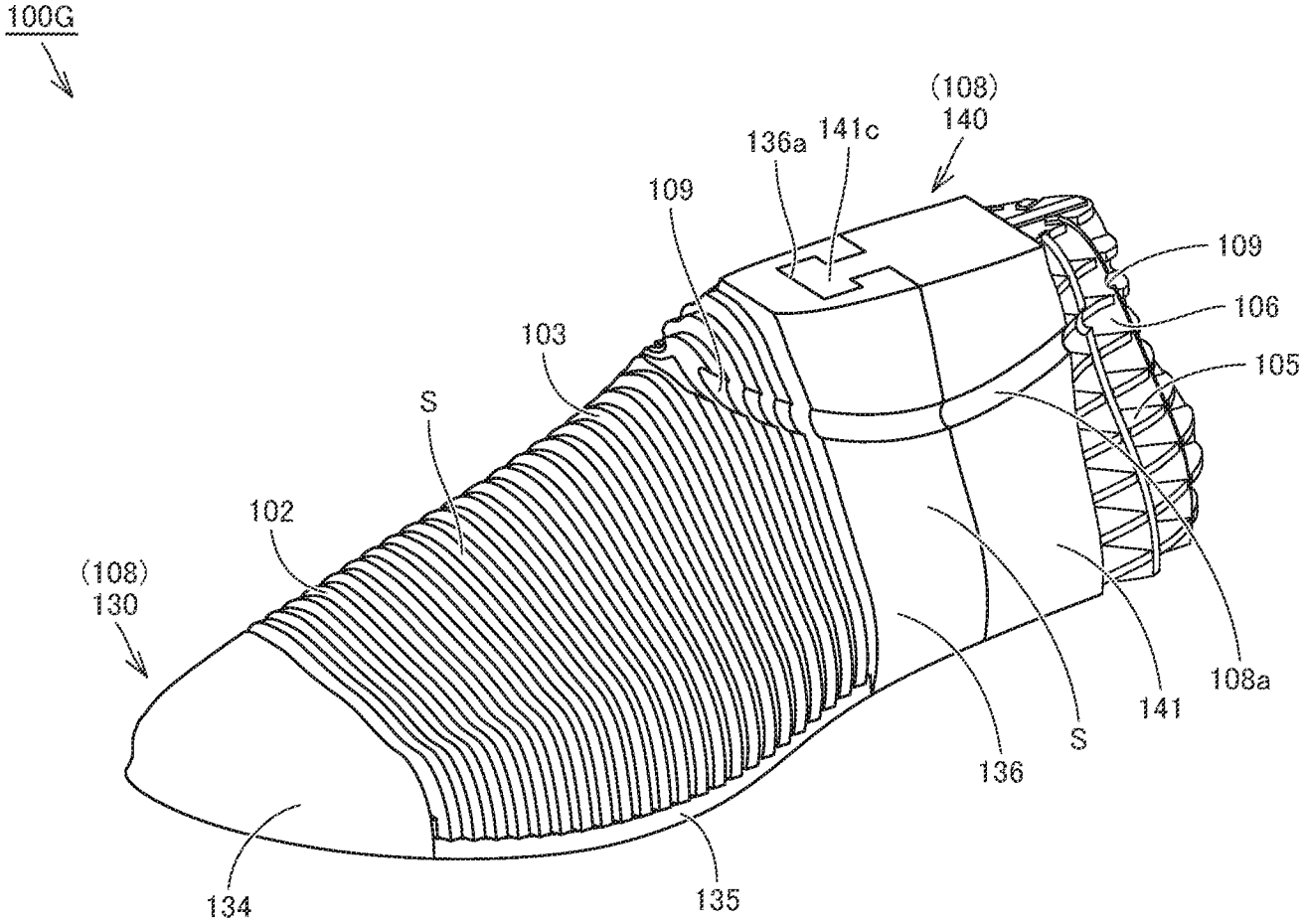
FIG. 24 is a perspective view of a last according to an eighth embodiment.

FIG. 24 is a perspective view of a last according to an eighth embodiment. Referring to FIG. 24, a last 100G according to the present embodiment will be hereinafter described. Note that the last 100G according to the present embodiment is fabricated according to the above-described method of producing a last model and basically conforms to the shape of a wearer's foot.

As shown in FIG. 24, the last 100G is the same as the last 100A according to the above-described first embodiment in that the last 100G is formed by combining a plurality of last forming parts but is different from the last 100A in the configuration in which the plurality of last forming parts include a block-shaped part in addition to the plurality of plate-shaped parts. More specifically, the plurality of last forming parts include a base part 108 as a block-shaped part, and a plurality of toe parts 102, a plurality of instep parts 103, a plurality of circumferential heel parts 105, and a plurality of vertical heel parts 106 as plate-shaped parts. The base part 108 is divided into two parts of a front-side base part 130 and a rear-side base part 140.

The front-side base part 130 includes: a front end-side toe portion 134 corresponding to the front end of the wearer's toe; a front-side foot sole portion 135 corresponding to the foot sole located at positions corresponding to the rear end of the wearer's toe and the wearer's instep; and a front-side ankle portion 136 corresponding to the front end of the wearer's ankle. Further, the rear-side base part 140 includes a rear-side ankle portion 141 corresponding to the rear end of the wearer's ankle.

The base part 108 formed of the front-side base part 130 and the rear-side base part 140 serves as a base frame to which the above-described plurality of plate-shaped parts are assembled, and defines the bottom surface of the last 100G. More specifically, the plurality of toe parts 102 and the plurality of instep parts 103 are assembled to the front-side base part 130, and the plurality of circumferential heel parts 105 and the plurality of vertical heel parts 106 are assembled to the rear-side base part 140. The front-side base part 130 and the rear-side base part 140 each may be made, for example, of resin, metal, wood, or the like, and are preferably made of hard resin.

On the other hand, the plurality of toe parts 102, the plurality of instep parts 103, the plurality of circumferential heel parts 105, and the plurality of vertical heel parts 106 have basically the same configurations as those in the last 100A according to the above-described first embodiment, and each are formed of a wooden board. In this case, the plurality of toe parts 102 and the plurality of instep parts 103 are arranged in a multilayered manner in the front-rear direction (i.e., in the foot length direction), and the plurality of circumferential heel parts 105 are arranged in a multilayered manner in the up-down direction (i.e., in the direction orthogonal to both the foot length direction and the foot width direction). Also, the plurality of vertical heel parts 106 are arranged radially in a multilayered manner in a range of approximately 180° around the axis extending in the up-down direction.

The base part 108, the plurality of toe parts 102, the plurality of instep parts 103, the plurality of circumferential heel parts 105, and the plurality of vertical heel parts 106 are combined to define a forming surface S of the last 100G. More specifically, the outer surface of the base part 108 defines the forming surface S of the last 100G. Also, the end surfaces of the plurality of toe parts 102, the plurality of instep parts 103, the plurality of circumferential heel parts 105, and the plurality of vertical heel parts 106 (i.e., the surfaces extending in the thickness direction of the plate-shaped parts) define the forming surface S of the last 100G.

In this case, the portion of the forming surface S that is defined by the base part 108 corresponds to a portion of the entire outer surface of the foot that is less likely to be different in shape for each wearer. On the other hand, the portion of the forming surface S that is defined by each of the plurality of toe parts 102, the plurality of instep parts 103, the plurality of circumferential heel parts 105, and the plurality of vertical heel parts 106 corresponds to a portion of the entire outer surface of the foot that is more likely to be different in shape for each wearer.

Thus, in the case where the last 100G is configured by combining the base part 108 as a block-shaped part with the plurality of toe parts 102, the plurality of instep parts 103, the plurality of circumferential heel parts 105, and the plurality of vertical heel parts 106 as a plurality of plate-shaped parts in this way, the last can be more efficiently fabricated by preparing the base part 108 in advance for each size of the shoe to be manufactured.

In this case, in the last 100G according to the present embodiment, recessed portions 109 and 108*a* are provided at the prescribed positions in the last 100G. The recessed portions 109 and 108*a* are located in a specific region of the forming surface S that corresponds to the upper end portion of the to-be-formed portion of the upper 30 of the shoe 1 to be manufactured. In the present embodiment, the above-mentioned upper end portion of the shoe 1 to be manufactured (the portion indicated by the reference character UP in FIGS. 1 and 2) is provided with a topline 31. Accordingly, the above-mentioned specific region of the forming surface S is a portion corresponding to the topline 31. Specifically, the recessed portion 109 is provided in each of the plurality of ankle parts 104, the plurality of circumferential heel parts 105, and the plurality of vertical heel parts 106. Also, the recessed portion 108*a* is provided in each of the front-side ankle portion 136 of the front-side base part 130 and the rear-side ankle portion 141 of the rear-side base part 140.

Therefore, also in the configuration as described above, the recessed portions 109 and 108*a* each can be used as a mark when the upper 30 is formed. Accordingly, the upper 30 can be easily aligned during forming of the upper 30, and thus, not only the finished quality of the shoe 1 to be manufactured is improved but also the productivity is significantly improved.

Further, in the last 100G according to the present embodiment, the front-side ankle portion 136 of the front-side base part 130 is provided with a recessed engagement portion 136*a* so as to reach the upper surface and the rear end surface of the front-side ankle portion 136, and the front end surface of the rear-side ankle portion 141 of the rear-side base part 140 is provided with a protruding engagement portion 141*c*.

The recessed engagement portion 136*a* and the protruding engagement portion 141*c* are configured to fit each other in the up-down direction (i.e., in the direction orthogonal to both the foot length direction and the foot width direction).

Thereby, the rear-side base part 140 can be insertable into and removable from the front-side base part 130 in the up-down direction. Thus, after the upper 30 is formed, at this portion, the rear-side base part 140 is disengaged from the front-side base part 130, and thereby, the rear-side base part 140 and the front-side base part 130 can be easily taken out in this order from the topline 31 of the upper 30.

SUMMARY OF THE DISCLOSURE IN EMBODIMENTS

The following summarizes the characteristic configurations disclosed in the above-described embodiments and the modifications thereof.

A last according to an aspect of the present disclosure is for shoe upper forming and is formed by combining a plurality of last forming parts, and a shoe upper is overlaid on the last to allow forming of the shoe upper. In a forming surface for forming the shoe upper, at least a portion of a specific region corresponding to an upper end portion of a to-be-formed portion of the shoe upper is defined by a plurality of plate-shaped parts included in the last forming parts. By arranging the plate-shaped parts to be spaced apart from each other in a circumferential direction of an upper end portion of the shoe upper, a portion of the specific region that is defined by the plate-shaped parts is defined by an end surface of each of the plate-shaped parts. In the last according to an aspect of to the present disclosure, a recessed portion as a mark used for alignment with the last during overlaying of the shoe upper is provided in the portion of the specific region that is defined by the plate-shaped parts.

In the last according to an aspect of the present disclosure, each of the plate-shaped parts may include a sandwiching portion that is capable of sandwiching and holding the shoe upper when the shoe upper is inserted into the sandwiching portion. In this case, it is preferable that the recessed portion is provided at an end portion of each of the plate-shaped parts, such that the sandwiching portion is formed by a portion defining the recessed portion of each of the plate-shaped parts.

In the last according to an aspect of the present disclosure, each of the plate-shaped parts may be formed of a wooden board.

A shoe upper forming tool according to another aspect of the present disclosure includes: the last according to an aspect of the present disclosure; and a fixing member having a string shape and used for fixing a shoe upper to the last. In the shoe upper forming tool according to another aspect of the present disclosure, the recessed portion is shaped and sized to be capable of accommodating at least a part of the fixing member so as to allow the shoe upper to be sandwiched and held between the recessed portion and the fixing member.

A shoe upper forming tool according to yet another aspect of the present disclosure includes: the last according to an aspect of the present disclosure; and a fixing member having a string shape and used for fixing a shoe upper to the last. In the shoe upper forming tool according to still another aspect of the present disclosure, the recessed portion is shaped and sized to be capable of retaining the fixing member accommodated in the recessed portion.

In the shoe upper forming tool according to another aspect of the present disclosure and the shoe upper forming tool according to still another aspect of the present disclosure, each of the plate-shaped parts may be formed of a wooden board.

In addition, each of the lasts according to the above-described embodiments can be used as a shoe keeper after forming of the upper completes. In that case, the forming surface of the last is to function as a retaining surface that retains the shape of a shoe.

OTHER EMBODIMENTS

The above embodiments have been described with reference to an example in which the present invention is applied to a last fabricated through the process of: photographing a wearer's foot to obtain image data; producing a last model dedicated to the wearer based on the image data; and fabricating a plurality of plate-shaped parts based on the last model. However, the present invention does not necessarily have to be applied only to such a last, but may also be naturally applicable to a last fabricated through a different process. For example, the present invention is applicable not to a last dedicated to a wearer but also to a last fabricated by a conventionally known method.

Further, in the above-described embodiments, as a shoe manufactured using the last to which the present invention is applied, a shoe whose upper is fabricated using an upper forming material having heat shrinkability has been exemplified. However, the shoe manufactured using the last to which the present invention is applied is not limited to such a shoe but may be any type of shoe. In other words, the last to which the present invention is applied can be used also in manufacturing any type of shoe having a conventionally known configuration.

Further, the allocation of parts (i.e., for example, as to where each part (including a plate-shaped part and a block-shaped part) is laid out in the last) in the last disclosed in each of the above-described embodiments can of course be variously changed. In other words, the number of parts, the size of each of the parts, the arrangement position of the parts, the method of combining the parts, and the like in the last disclosed in each of the above-described embodiments and the modifications thereof are provided merely by way of example.

Further, the recessed portions disclosed in the above embodiment can be appropriately changed in shape, size, and number.

In addition, the characteristic configurations disclosed in the above-described embodiments can be combined with each other without departing from the gist of the present invention.

Although the present invention has been described and illustrated in detail, it is clearly understood that the same is by way of illustration and example only and is not to be taken by way of limitation, the scope of the present invention being interpreted by the terms of the appended claims.

The invention claimed is:

1. A last for forming a shoe upper, the last comprising:

a plurality of last forming parts, wherein in a forming surface for forming the shoe upper, at least a portion of a specific region corresponding to an upper end portion of a to-be-formed portion of the shoe upper is defined by a plurality of plate-shaped parts included in the last forming parts, by arranging the plate-shaped parts to be spaced apart from each other in a circumferential direction of an upper end portion of the shoe upper, a portion of the specific region that is defined by the plate-shaped parts is defined by an end surface of each of the plate-shaped parts, the end surface of one of the plate-shaped parts has a notched recessed portion as a mark used for alignment with the last during overlaying of the shoe upper, the recessed portion being disposed in the portion of the specific region that is defined by the plate-shaped parts, and the recessed portion is separate from a slit extending to the end surface of the one of the plate-shaped parts for assembling the one of the plate-shaped parts to another one of the plate-shaped parts.

2. The last according to claim 1, wherein each of the plate-shaped parts is configured of a wooden board.

3. The last according to claim 1, wherein each of the plate-shaped parts includes a sandwiching portion that is configured to sandwich and hold the shoe upper when the shoe upper is inserted into the sandwiching portion, and the recessed portion is at an end portion of each of the plate-shaped parts, such that the sandwiching portion is configured by a portion defining the recessed portion of each of the plate-shaped parts.

4. The last according to claim 3, wherein each of the plate-shaped parts is configured of a wooden board.

5. A shoe upper forming tool comprising:

the last according to claim 1; and a fixing member having a string shape and used for fixing the shoe upper to the last, wherein the recessed portion is shaped and sized to accommodate at least a part of the fixing member to allow the shoe upper to be sandwiched and held between the recessed portion and the fixing member.

6. The shoe upper forming tool according to claim 5, wherein each of the plate-shaped parts is configured of a wooden board.

7. A shoe upper forming tool comprising:

the last according to claim 1; and a fixing member having a string shape and used for fixing the shoe upper to the last, wherein the recessed portion is shaped and sized to retain the fixing member accommodated in the recessed portion.

8. The shoe upper forming tool according to claim 7, wherein each of the plate-shaped parts is configured of a wooden board.

* * * * *